US012501949B2

(12) United States Patent
Pathy et al.

(10) Patent No.: US 12,501,949 B2
(45) Date of Patent: Dec. 23, 2025

(54) APPARATUS AND METHOD FOR PROTECTION OF BODY AREAS UPON IMPACT

(71) Applicant: OrthoProtect Technologies LLC, Madison, CT (US)

(72) Inventors: Shailen Pathy, Madison, CT (US); Gennady Kleyman, Brooklyn, NY (US)

(73) Assignee: OrthoProtect Technologies LLC, Madison, CT (US)

( * ) Notice: Subject to any disclaimer, the term of this patent is extended or adjusted under 35 U.S.C. 154(b) by 52 days.

(21) Appl. No.: 18/416,220

(22) Filed: Jan. 18, 2024

(65) Prior Publication Data

US 2025/0234942 A1 Jul. 24, 2025

(51) Int. Cl.

| | |
|---|---|
| ***A41D 13/018*** | (2006.01) |
| ***A41D 13/015*** | (2006.01) |
| ***A41D 13/05*** | (2006.01) |
| ***A41F 9/00*** | (2006.01) |

(52) U.S. Cl.

CPC ..... *A41D 13/018* (2013.01); *A41D 13/0155* (2013.01); *A41D 13/0506* (2013.01); *A41F 9/002* (2013.01)

(58) Field of Classification Search

CPC ..... A41F 9/002

See application file for complete search history.

(56) References Cited

U.S. PATENT DOCUMENTS

| | | | | |
|---|---|---|---|---|
| 4,365,628 | A | 12/1982 | Hodel | |
| 5,500,952 | A * | 3/1996 | Keyes | A41D 13/018 2/908 |
| 5,584,072 | A | 12/1996 | Kim et al. | |
| 5,636,377 | A | 6/1997 | Wiener | |
| 6,032,299 | A * | 3/2000 | Welsh | A41D 13/018 2/467 |
| 6,330,931 | B1 | 12/2001 | Baillargeon et al. | |
| 6,808,205 | B2 | 10/2004 | Hawthorn et al. | |
| 6,883,640 | B2 | 4/2005 | Kurtgis | |
| 6,920,647 | B2 * | 7/2005 | Ulert | A41D 13/018 2/DIG. 3 |
| 7,150,048 | B2 | 12/2006 | Buckman | |
| 7,548,168 | B2 | 6/2009 | Ishikawa et al. | |
| 8,330,305 | B2 | 12/2012 | Hart et al. | |
| 9,687,035 | B2 | 6/2017 | Shibaya et al. | |

(Continued)

FOREIGN PATENT DOCUMENTS

| | | | |
|---|---|---|---|
| CN | 103932445 | A | 7/2014 |
| CN | 107123239 | A | 9/2017 |

(Continued)

*Primary Examiner* — Jocelyn Bravo

(74) *Attorney, Agent, or Firm* — Troutman Pepper Locke LLP; Scott D. Wofsy; Gabrielle L. Gelozin

(57) ABSTRACT

The subject disclosure is directed to a new and useful apparatus for protecting a user. The apparatus has an elongated belt dimensioned and configured to be worn about the waist of a user. The apparatus has at least one inflatable/deflatable airbag supported on the belt. The apparatus has an inflate/deflate pump supported on the belt which communicates with the at least one inflatable/deflatable airbag for inflating the at least one inflatable/deflatable airbag upon receiving an activation signal.

20 Claims, 21 Drawing Sheets

(56) References Cited

U.S. PATENT DOCUMENTS

| | | | | |
|---|---|---|---|---|
| 9,974,345 | B2 | 5/2018 | Raanan | |
| 10,149,638 | B2 | 12/2018 | Buckman | |
| 11,253,013 | B2 | 2/2022 | Hyde et al. | |
| 2004/0003455 | A1 | 1/2004 | Davidson | |
| 2006/0049950 | A1 | 3/2006 | Lockhart | |
| 2013/0192336 | A1* | 8/2013 | O'Connor | A61B 5/1117 73/12.01 |
| 2013/0312168 | A1* | 11/2013 | Raanan | A61B 5/6831 2/465 |
| 2014/0352042 | A1* | 12/2014 | Celi | A41D 13/0155 2/455 |
| 2016/0379461 | A1* | 12/2016 | Gaidar | A41D 13/1281 340/573.1 |
| 2019/0261705 | A1* | 8/2019 | Lofgran | A41D 13/018 |
| 2020/0029633 | A1 | 1/2020 | Bowles | |
| 2022/0232910 | A1* | 7/2022 | Yanagisawa | A41D 13/0506 |
| 2022/0273052 | A1* | 9/2022 | Nidam | A41D 31/065 |

FOREIGN PATENT DOCUMENTS

| | | | |
|---|---|---|---|
| CN | 108433211 | A | 8/2018 |
| CN | 210696050 | U | 6/2020 |
| CN | 212382182 | U | 1/2021 |
| CN | 213399925 | U | 6/2021 |
| CN | 213458393 | U | 6/2021 |
| CN | 214047581 | U | 8/2021 |
| CN | 114617320 | A | 6/2022 |
| IN | 202121006119 | | 9/2021 |
| JP | 2003312569 | A | 11/2003 |
| JP | 2006288435 | A | 10/2006 |
| JP | 2017205153 | A | 11/2017 |
| KR | 101436069 | B1 | 8/2014 |
| KR | 102136171 | B1 | 7/2020 |
| KR | 102201831 | B1 | 1/2021 |
| KR | 102225365 | B1 | 3/2021 |
| KR | 1020220113144 | | 8/2022 |
| WO | WO-2022120918 | A1 | 6/2022 |

* cited by examiner

APPARATUS AND METHOD FOR PROTECTION OF BODY AREAS UPON IMPACT

BACKGROUND OF THE DISCLOSURE

I. Field of the Disclosure

This disclosure relates to a wearable apparatus and method of deployment to protect a user from impact.

II. Description of Related Art

There is a need for improved protection for those prone to falling, especially for elderly people who are more prone to serious injuries upon falling. Over time, bones become more brittle, making falling at an older age more dangerous and possibly life threatening. Further, undergoing surgery as a result of a serious fall is more dangerous and provides a greater risk to those of an older age.

There is a need for practical and easy to wear devices to protect especially fragile areas of the human body which are the most prone to injury upon falling. Traditional approaches have incorporated the use of inflatable airbags, cushions, and padding. However, traditional methods often include rigid canisters, obstructive batteries, and other bulky components that assist in activation of the device and are often single-use devices requiring replacement of parts after one use. Traditional approaches are often uncomfortable for the user to wear. It would be advantageous to make such devices more practical to wear and more comfortable for the user.

Some traditional approaches have incorporated active protective garments and motion analysis systems for protecting individuals from falls. For example, as described in U.S. Pat. No. 7,017,195, issued on Mar. 28, 2006, U.S. Pat. No. 7,150,048, issued on Dec. 19, 2006, and U.S. Pat. No. 9,107,615, issued on Aug. 18, 2015. These traditional approaches include detection of a fall, activation of a device, and protection of a user. The protection mechanism of these approaches is automatically deployed via an air bag inflator when sensors detect accelerations, directions, or rotations associated with the early phases of an accidental fall. Traditional motion analysis systems include orientation sensors configured to detect three-dimensional torso motion over time, multiaxial accelerometers configured to detect acceleration in at least three orthogonal directions, gyroscopes, and controllers configured to receive data from the orientation sensors and determine a state and a transition of the torso, identify normal parameters for the determined state and transition, and determine whether motion of the torso is outside the normal parameters, thereby detecting a user falling. These traditional devices, cannot protect the user from side impact (e.g., hitting a door frame, wall, etc.). Further these types of sensors often malfunction and the airbags can fail to inflate on time. Methods of air inflation used by such traditional devices (e.g., containers with pressurized air) can be dangerous to wear in hot or direct sun environments. It would be advantageous to make such devices more accurate, reliable, and safer to wear.

Other traditional approaches include wearable garments which reduce the impact force to the trochanteric region of a wearer upon a fall from a standing position using pads made from different type of shock absorbing resilient materials. For example, as described in U.S. Pat. Nos. 5,636,377, 8,065,753, and 8,381,320. These traditional approaches come in the form of wearable shorts which can be difficult for elderly individuals, who are the most prone to falling, to put on and off without assistance. Further, such traditional garments include bulky padding, which can be uncomfortable for the user. Such pads can also block air circulation in the area to be protected, which can cause an unwanted skin reactions. It would be advantageous to make such device smore practical and comfortable for everyday use.

Such conventional methods and systems have generally been considered satisfactory for their intended purpose. However, there is still a need in the art for improved protection for those prone to falling that are more user-friendly, comfortable to wear, capable of providing protection from both falls and other impacts (e.g., side impacts), more practical, less restrictive, safer, and more reliable so as to promote higher level of usage. The present disclosure provides a solution for this need.

SUMMARY OF THE DISCLOSURE

The subject disclosure is directed to a new and useful apparatus for protecting a user. The apparatus has an elongated belt dimensioned and configured to be worn about the waist of a user. The apparatus has at least one inflatable/deflatable airbag supported on the belt. The apparatus has an inflate/deflate pump supported on the belt which communicates with the at least one inflatable/deflatable airbag for inflating the at least one inflatable/deflatable airbag upon receiving an activation signal. The apparatus further includes at least one pressure sensor configured to detect a pressure within the at least one inflatable/deflatable airbag.

A first pressure sensor is operatively associated with a first inflatable/deflatable airbag for sensing pressure therein, so as to detect a target pressure inside the first inflatable/deflatable airbag, wherein upon detecting the target pressure, the first pressure sensor sends signal to the inflate/deflate pump to stop inflating the so as to detect a target safety pressure inside the first inflatable/deflatable airbag. The first pressure sensor is operatively connected to an electronic controller associated with the inflate/deflate pump by way of a first communication line. A second pressure sensor is operatively associated with a second inflatable/deflatable airbag for sensing pressure therein, so as to detect a target pressure inside the first inflatable/deflatable airbag, wherein upon detecting the target pressure, the second pressure sensor sends signal to the inflate/deflate pump to stop inflating the second inflatable/deflatable airbag. The second pressure sensor is operatively connected to the electronic controller associated with the inflate/deflate pump by way of a second communication line. The first pressure sensor and the second pressure sensor are configured and adapted to detect a target pressure. Upon detecting the target pressure, the first inflatable/deflatable airbag and the second inflatable/deflatable airbag are configured to stop inflating or stop deflating.

A first control valve is operatively associated with the electronic controller for controlling a flow of air between the first inflatable/deflatable airbag and the inflate/deflate pump. A second control valve is operatively associated with the electronic controller for controlling a flow of air between the second inflatable/deflatable airbag and the inflate/deflate pump.

In certain embodiments, the first inflatable/deflatable airbag and the second inflatable/deflatable airbag are supported on the belt in a spaced apart relationship. In certain other embodiments, the at least one inflatable/deflatable airbag extends substantially around the user's waist.

In certain embodiments, a first tube extends from the inflate/deflate pump to the first inflatable/deflatable airbag for supplying pressurized air from the inflate/deflate pump. A second tube extends from the inflate/deflate pump to the second inflatable/deflatable airbag for supplying pressurized air from the inflate/deflate pump.

The electronic controller is operatively associated with the inflate/deflate pump for activating the inflate/deflate pump upon receiving the activation signal. The activation signal can be initiated by a user. The inflate/deflate pump is configured and adapted to inflate the first inflatable/deflatable airbag and the second inflatable/deflatable airbag in a first mode of operation after receiving the activation signal and configured and adapted to deflate the first inflatable airbag and the second inflatable airbag in a second mode of operation after receiving the activation signal. In certain embodiments, the apparatus further includes means for switching between the first mode of operation and the second mode of operation. The means is operatively associated with the electronic controller.

In some embodiments a position sensor is operatively associated with the electronic controller for sensing a change in a user's position. The activation signal can be initiated by detection of a change in the user's position. In this embodiment, the apparatus further includes means for activating and/or deactivating the position sensor. The means for activating and/or deactivating the position sensor is operatively associated with the electronic controller. Upon sensing a change in the user's position from a first position to a second position, the electronic controller commands the inflate/deflate pump to inflate the first inflatable/deflatable airbag and the second inflatable/deflatable airbag. Upon sensing a change in the user's position from the second position to a third position, the electronic controller commands the inflate/deflate pump to deflate the first inflatable/deflatable airbag and the second inflatable/deflatable airbag.

The subject disclosure is also related to an apparatus for protecting a user which includes an elongated belt dimensioned and configured to be worn about the waist of a user, at least one inflatable/deflatable airbag supported on the belt, and an inflate/deflate pump supported on the belt and communicating with the at least one inflatable/deflatable airbag for inflating the at least one inflatable/deflatable airbag upon receiving an activation signal indicative of a change in the user's position. A first pressure sensor is operatively associated with a first inflatable/deflatable airbag for sensing pressure therein, so as to detect a target pressure therein. The first pressure sensor is operatively connected to an electronic controller associated with the inflate/deflate pump by way of a first communication line.

A second pressure sensor is operatively associated with a second inflatable/deflatable airbag for sensing a pressure therein, so as to detect a target pressure therein. The second pressure sensor is operatively connected to the electronic controller associated with the inflate/deflate pump by way of a second communication line. The first pressure sensor and the second pressure sensor are configured and adapted to detect a target pressure. Upon detecting the target pressure, the first inflatable airbag and the second inflatable airbag are configured to stop inflating or stop deflating.

A first control valve is operatively associated with the electronic controller for controlling a flow of air between the first inflatable/deflatable airbag and the inflate/deflate pump. A second control valve is operatively associated with the electronic controller for controlling a flow of air between the second inflatable/deflatable airbag and the inflate/deflate pump.

In certain embodiments, the first inflatable/deflatable airbag and the second inflatable/deflatable airbag are supported on the belt in a spaced apart relationship. A first tube extends from the inflate/deflate pump to the first inflatable airbag for supplying pressurized air from the inflate/deflate pump. A second tube extends from the inflate/deflate pump to the second inflatable airbag for supplying pressurized air from the inflate/deflate pump. The electronic controller is operatively associated with the inflate/deflate pump for activating the inflate/deflate pump upon receiving the activation signal indicative of a change in the user's position.

In certain embodiments, a position sensor is operatively associated with the electronic controller for sensing a change in a user's position. Upon sensing a change in the user's position from a first position to a second position, the electronic controller commands the inflate/deflate pump to inflate the first inflatable/deflatable airbag and the second inflatable/deflatable airbag. Upon sensing a change in the user's position from the second position to a third position, the electronic controller commands the inflate/deflate pump to deflate the first inflatable/deflatable airbag and the second inflatable/deflatable airbag.

The subject disclosure is also related to a method for deploying an apparatus for protecting a user. The method includes providing a user with an apparatus for protecting a user configured to be worn around the user's waist, detecting a first change in position of the user wearing the apparatus, inflating the apparatus upon the first change in position of the user, detecting a second change in position of the user wearing the apparatus, and deflating the apparatus upon the second change in position of the user.

The subject disclosure is also related to a method for deploying an apparatus for protecting a user. The method includes providing a user with an apparatus for protecting a user configured to be worn around the user's waist, sending an activation signal to inflate the airbags by way of means associated with the electronic controller, and sending a second activation signal to deflate the airbags by way of the means.

The subject disclosure is also related to a method for monitoring an apparatus for protecting a user. The method includes providing a user with an apparatus for protecting a user configured to be worn around the user's waist, detecting a pressure increase in one or more inflated airbags of the apparatus, and sending an emergency alert signal in response to detecting the pressure increase inside the inflated airbags.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE DISCLOSURE

Figure 1:
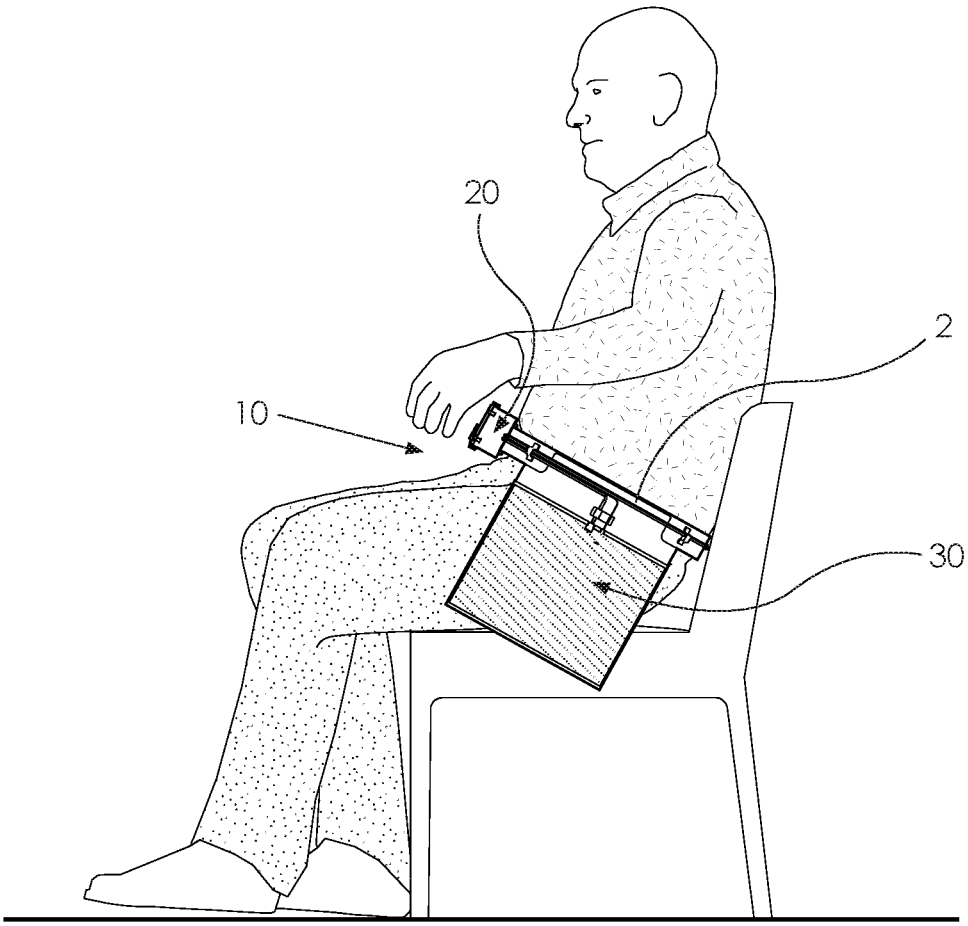
FIG. 1 shows a user in a seated position wearing an apparatus for protecting a user of the subject disclosure showing the apparatus deflated.

Reference will now be made to the drawings wherein like reference numerals identify similar structural features or aspects of the subject disclosure. For purposes of explanation and illustration, and not limitation, an illustrative view of an embodiment of an apparatus for protecting a user in accordance with the disclosure is shown in FIG. 1 and is designated generally by reference character 10. Other embodiments and/or aspects of this disclosure are shown in FIGS. 2-49.

Figure 2:
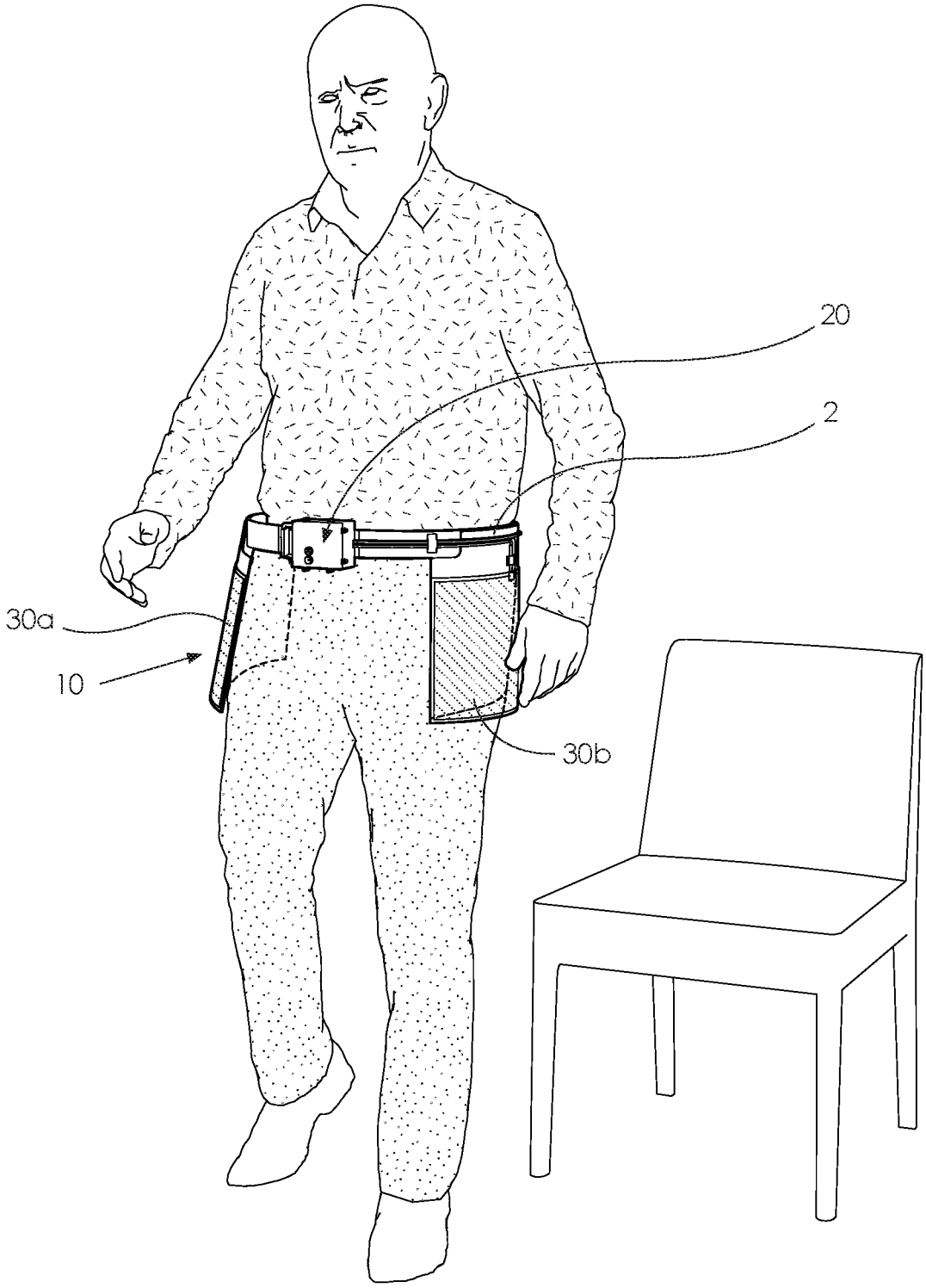
FIG. 2 shows a user in a standing position wearing the apparatus of FIG. 1, showing the apparatus deflated.
Figure 3:
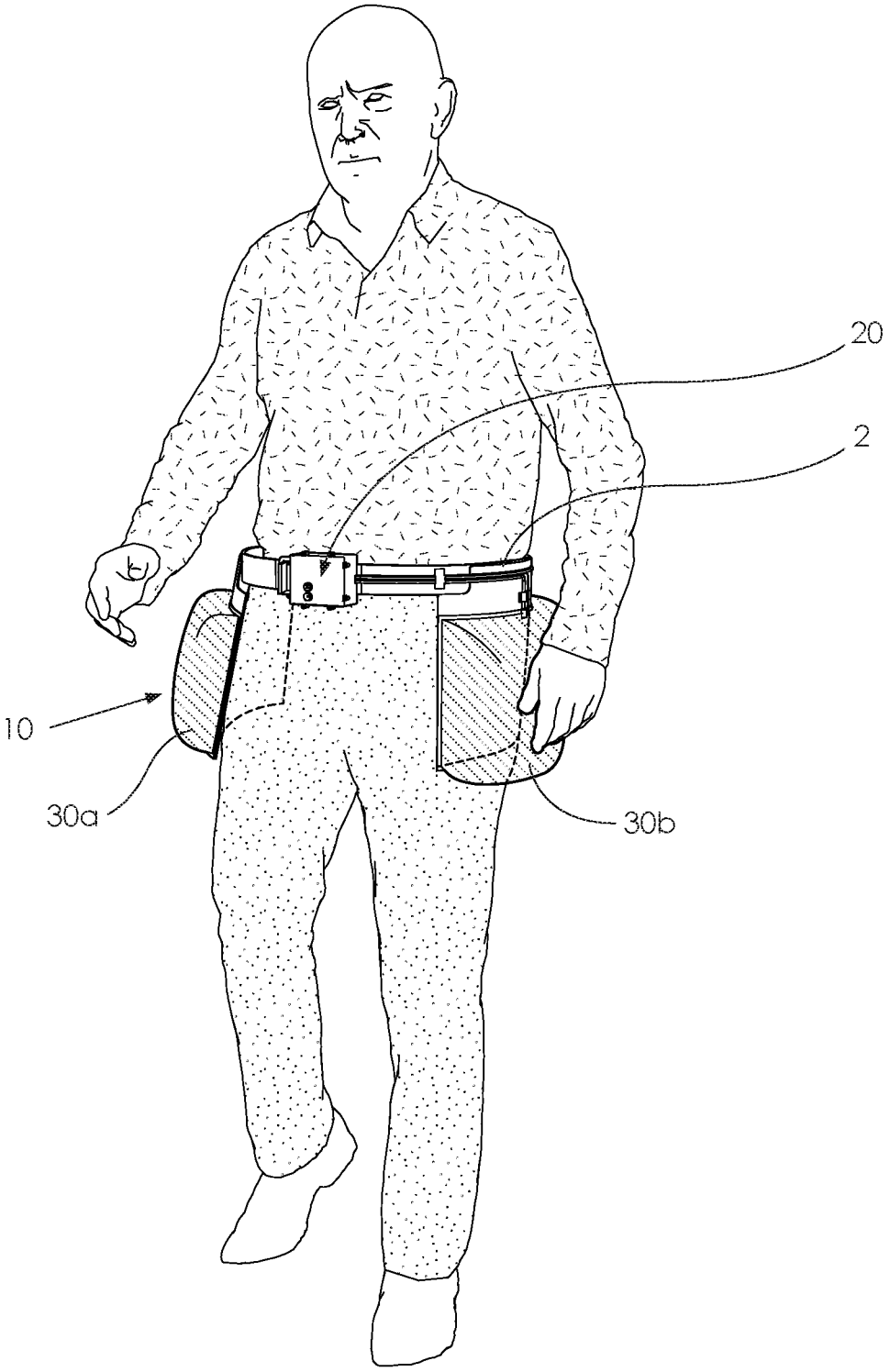
FIG. 3 shows a user in a standing position wearing the apparatus of FIG. 1, showing the apparatus inflated.
Figure 4:
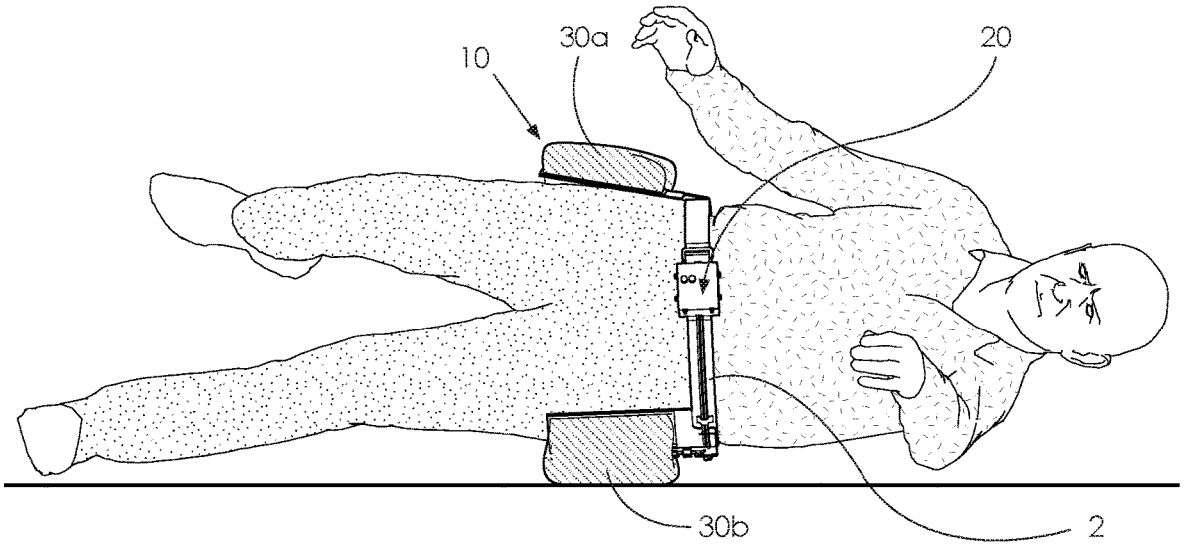
FIG. 4 shows a user in a fallen position wearing the apparatus of FIG. 1, showing the apparatus inflated.
Figure 16:
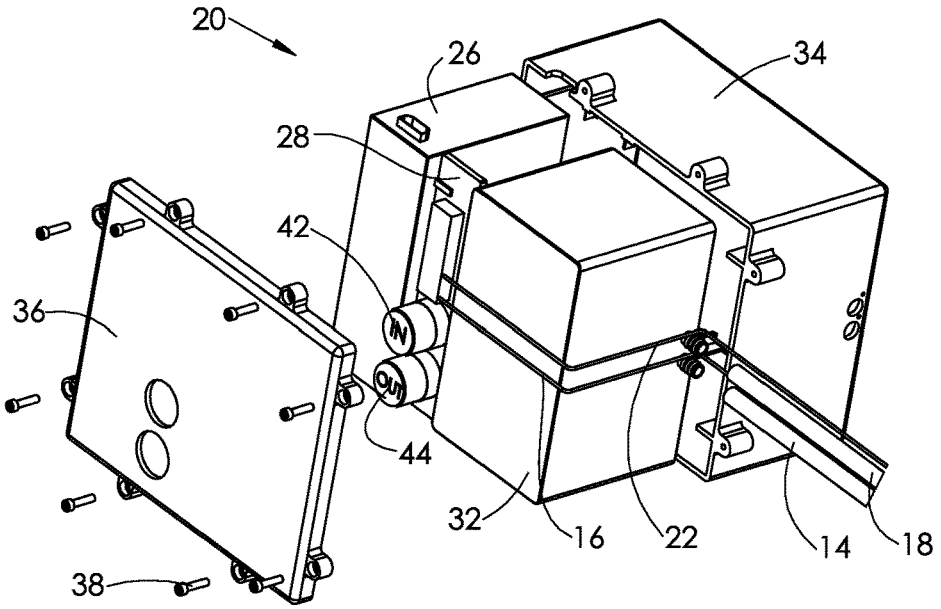
FIG. 16 is an exploded view of the pump control unit of FIG. 13, showing an electronic controller and an inflate/deflate pump within the pump housing unit.

With reference to FIGS. 1-4, a new and useful apparatus for protecting a user 10 is shown. The apparatus 10 has an elongated belt 2 dimensioned and configured to be worn about the waist of a user. The apparatus 10 has at least one inflatable/deflatable airbag 30 supported on the belt 2. The apparatus 10 has an inflate/deflate pump 32 (e.g., as shown in FIG. 16 within the pump housing unit 20) housed within a pump housing unit 20 supported on the belt 2 which communicates with the at least on inflatable airbag 30 for inflating and/or deflating the at least one inflatable airbag 30 upon receiving an activation signal (e.g., the activation signal can be initiated manually by a user and can also be initiated by detecting a changer in the user's position via a position sensor as described in detail below). In FIG. 1, a user is shown wearing the apparatus 10. The user is in a seated position and the at least one inflatable airbag 30 is deflated. In FIG. 2, a user is shown wearing the apparatus 10 and is in a standing position. Two inflatable/deflatable airbags 30*a* and 30*b* are shown supported by the belt 2 covering the hip area of the user, each of which are shown deflated. In FIG. 3, the inflatable/deflatable airbags 30*a* and 30*b* are shown inflated. In FIG. 4, a user is shown having fallen while wearing the apparatus 10. The inflatable/deflatable airbags 30*a* and 30*b* are shown inflated so as to protect the user upon impact.

Figure 5:
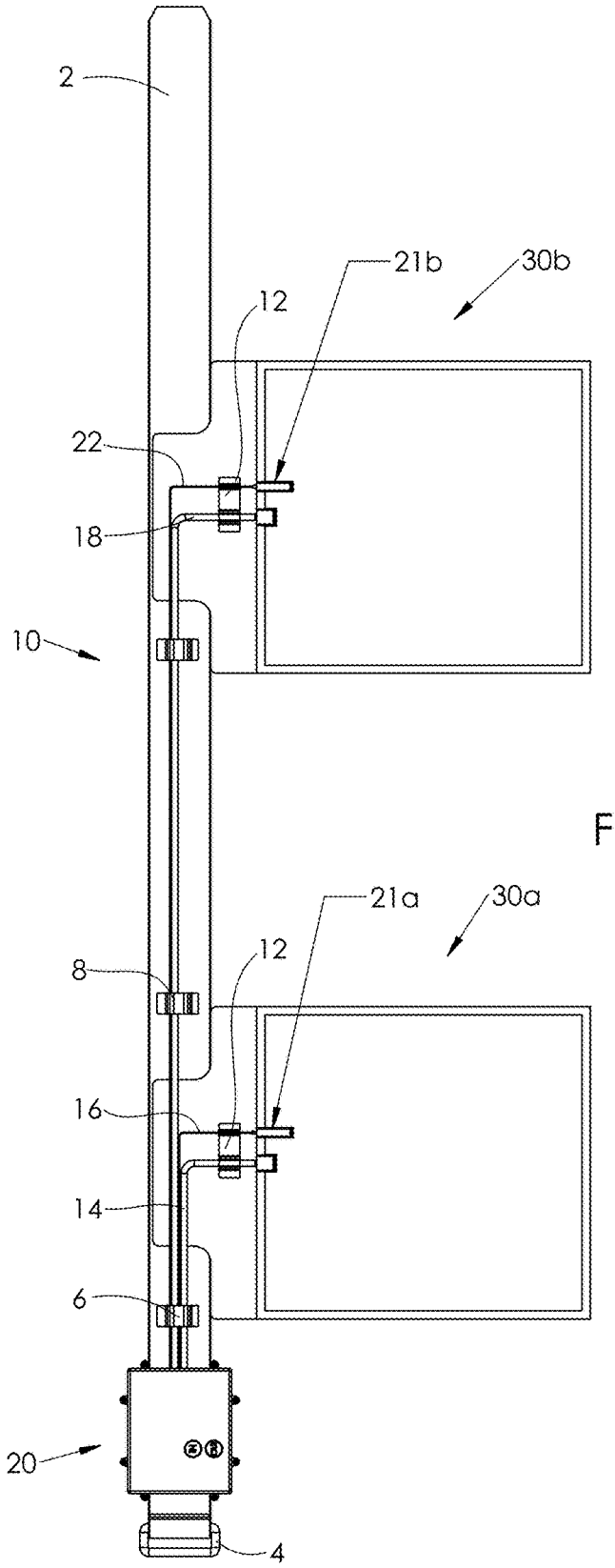
FIG. 5 is a front view of an apparatus for protecting a user, showing a first inflatable airbag, a second inflatable airbag and a pump housing unit supported on a belt.

With reference to FIG. 5, the apparatus 10 is shown. The belt 2 is shown with a buckle 4 to secure the belt 2 around the waist of a user. The belt 2 can include holes by which the buckle 4, may be attached. The buckle 4 may attach by any other means (e.g., snap fit mechanism). It is contemplated that in addition to a buckle, any means of securing the belt to the waist of a user can be used, e.g., Velcro strap, tying a knot, etc. The belt 2 is configured to be adjustable so as to accommodate the varying waist sizes of multiple users. The belt 2 can vary in length to accommodate varying waist sizes of multiple users. The pump housing unit 20 is shown supported by the belt 2. A first inflatable/deflatable airbag 30*a* and a second inflatable/deflatable airbag 30*b* are shown supported by belt 2. The apparatus includes at least one pressure sensor 21 configured to sense a pressure within the at least one inflatable/deflatable airbags (e.g., this can be a target pressure which tells the airbags when to stop inflating when the airbag is full and stop deflating when the airbag is empty).

Figure 17:
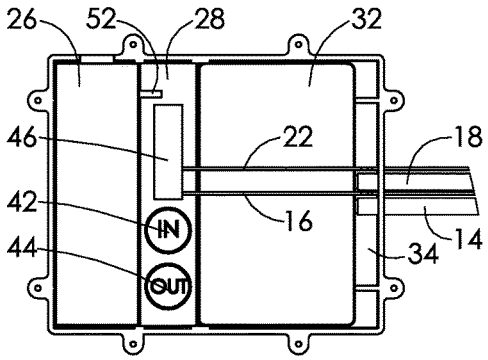
FIG. 17 is a front view of the pump control unit of FIG. 13 with a pump housing cover removed.

A first pressure sensor 21*a* is operatively associated with a first inflatable/deflatable airbag 30*a* for sensing pressure therein, so as to detect a target pressure theerin. The first pressure sensor 21*a* is operatively connected to an electronic controller 46 (e.g., as shown in FIGS. 16 and 17 within the pump housing unit 20) associated with the inflate/deflate pump 32 (e.g., as shown in FIGS. 16 and 17 within the pump housing unit 20) by way of a first communication line 16. A second pressure sensor 21*b* is operatively associated with a second inflatable/deflatable airbag 30*b* for sensing a pressure therein, so as to detect a second target pressure therein. The second pressure sensor 21*b* is operatively connected to the electronic controller 46 associated with the inflate/deflate pump 32 by way of a second communication line 22. Each of the first communication line 16 and the second communication line 22 is secured to the belt via a wire/tube holder 6, 8 and secured to each of the first inflatable airbag 30*a* and the second inflatable airbag 30*b* via a wire/tube holder 12.

The electronic controller 46 is operatively associated with the inflate/deflate pump 32 for activating the inflate/deflate pump 32 upon receiving the activation signal (e.g., the activation signal can be initiated by a user). The inflate/deflate pump 32 is configured and adapted to inflate the first inflatable/deflatable airbag 30*a* and the second inflatable/deflatable airbag 30*b* in a first mode of operation and configured and adapted to deflate the first inflatable/deflatable airbag 30*a* and the second inflatable/deflatable airbag 30*b* in a second mode of operation.

The first pressure sensor 21*a* and the second pressure 21*b* are configured and adapted to detect a target pressure. The target pressure is the pressure within each of the first inflatable/deflatable airbag 30*a* and the second inflatable/deflatable airbag 30*b* needed to effectively protect a user upon falling or impact. For example, each of the first and second inflatable/deflatable airbags will stop inflating when the maximum pressure needed within the airbags to protect the user is reached. The target pressure is also a pressure within each of the airbags bags upon which the airbags are completely deflated and the apparatus can safely be removed. For example, each of the airbags will stop inflating when the airbags are empty. The first and second position sensors detect the target pressure to determine when the airbags should stop inflating in one mode and deflating in another mode. The target pressure needed can vary based upon the individual user wearing the airbag assembly 10 (e.g., height, weight, and other factors). Upon detecting the target pressure, the first inflatable/deflatable airbag 30*a* and the second inflatable/deflatable airbag 30*b* are configured to stop inflating.

With continued reference to FIG. 5, the first inflatable/deflatable airbag 30*a* and the second inflatable/deflatable airbag 30*b* are supported on the belt 2 in a spaced apart relationship. As shown, the first inflatable/deflatable airbag 30*a* and the second inflatable/deflatable airbag 30*b*, can be spaced apart by 50%. It is contemplated herein that the belt 2 can accommodate less than two airbags (e.g., a shown in FIGS. 40-41) or more than two airbags. For example, the belt 2 can accommodate 4 airbags spaced apart by 25%, or any other number of airbags with varying arrangements and spaced apart relationships.

A first tube 14 extends from the inflate/deflate pump 32 within the pump housing unit 20 to the first inflatable/deflatable airbag 30*a* for supplying pressurized air from the inflate/deflate pump 32. A second tube 18 extends from the inflate/deflate pump 32 in the pump housing unit 20 to the second inflatable/deflatable airbag 30*b* for supplying pressurized air from the inflate/deflate pump 32. Each of the first tube 14 and the second tube 18 is secured to the belt 2 via a wire/tube holder 6, 8 and secured to each of the first inflatable airbag 30*a* and the second inflatable airbag 30*b* via a wire/tube holder 12.

Figure 6:
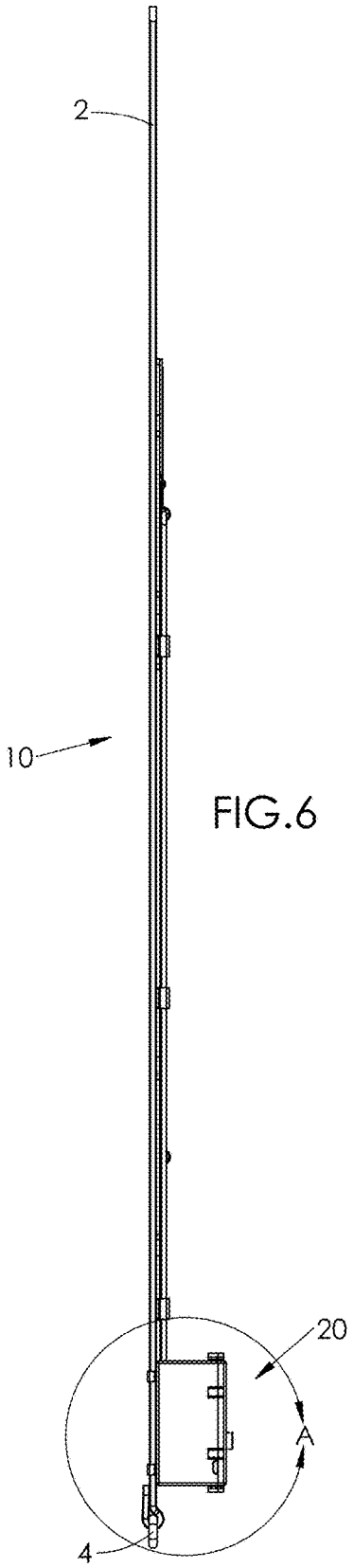
FIG. 6 is a top view of the apparatus of FIG. 5.
Figure 7:
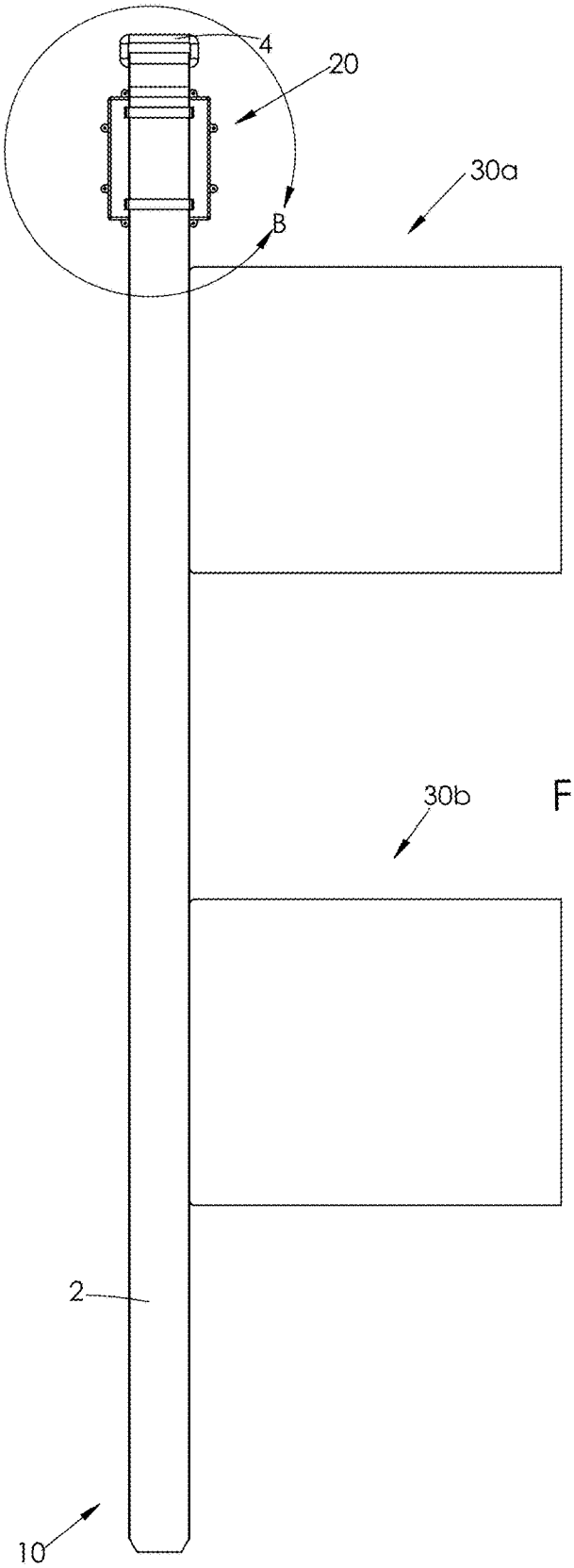
FIG. 7 is a rear view of the apparatus of FIG. 5.
Figure 8:
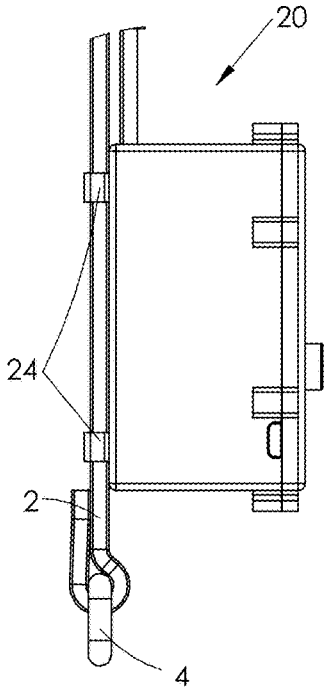
FIG. 8 is an enlarged detailed view taken from FIG. 6, showing the pump housing unit attached to the belt via a belt holder structure and a buckle.
Figure 9:
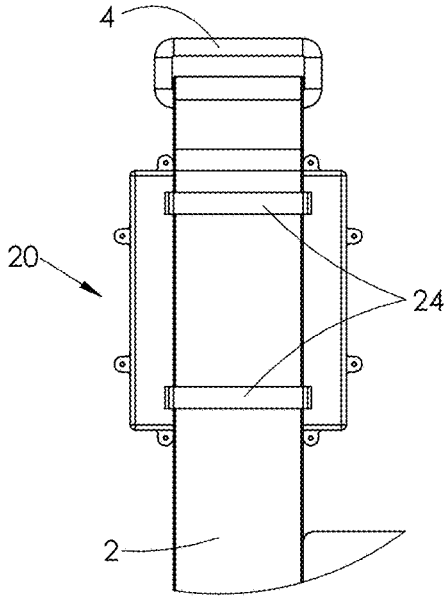
FIG. 9 is an enlarged detailed view taken from FIG. 7, showing the pump housing unit attached to the belt via a belt holder structure and a buckle.

With references to FIGS., 6-9 various views of the apparatus 10 are shown. FIG. 6 shows the apparatus 10 from a top view. FIG. 7 shows a rear view of the apparatus 10. FIG. 8 is an enlarged view taken from FIG. 6 of the pump housing unit 20. FIG. 9 shows an enlarged view taken from FIG. 7 of the pump housing unit 20. The pump housing unit 20 is shown secured to the belt 2 via a belt holder structure 24 located on the back side of the pump housing unit 20. The belt holder structure 24 is shown as to loops which the belt 2 is configured to pass through, however any other means of supporting the pump housing unit 20 on the belt 2 is contemplated herein. For example, the pump housing unit 20 can be formed with the belt 2, have Velcro straps, or any other means of attachment.

Figure 10:
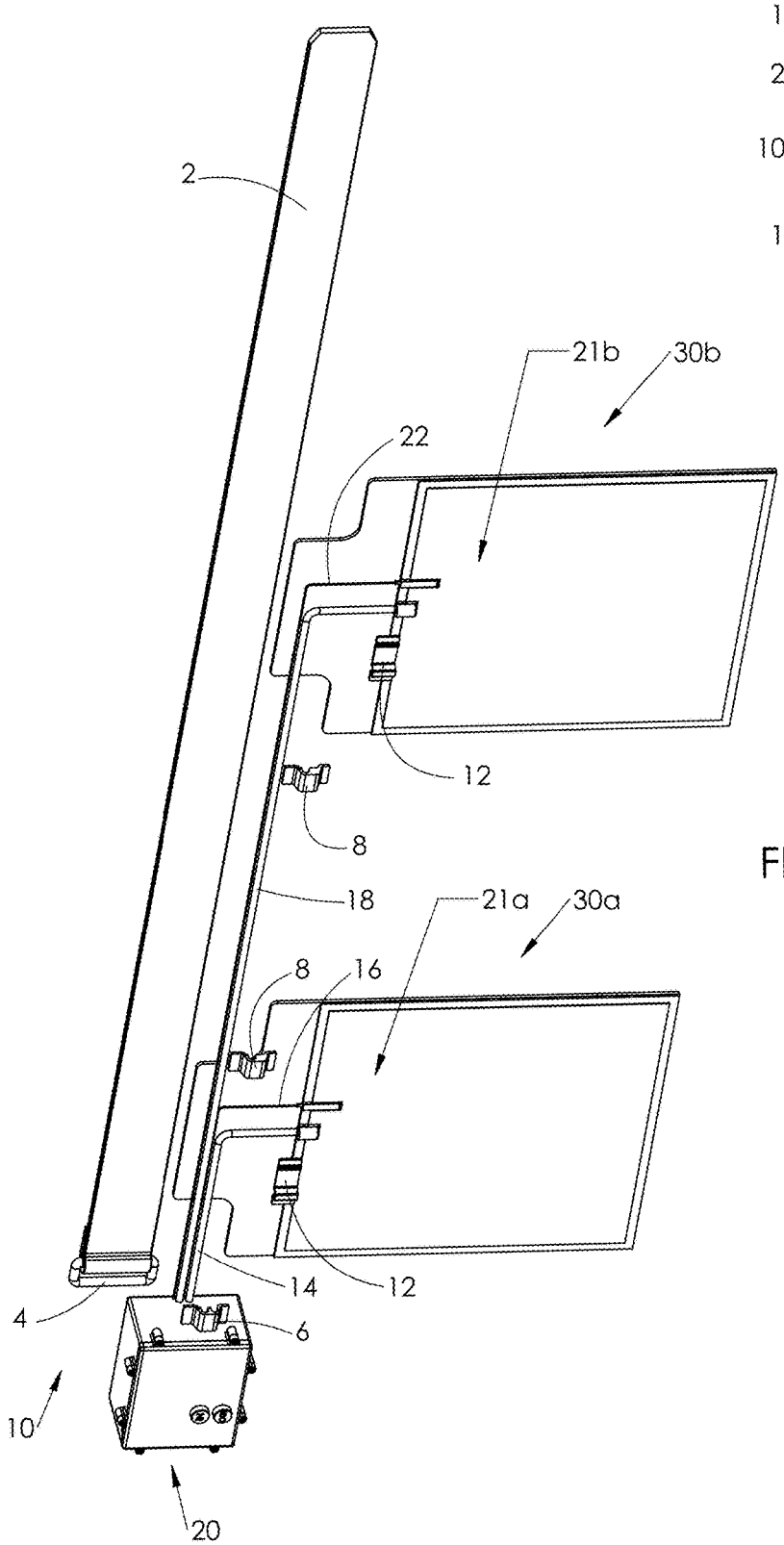
FIG. 10 is an exploded view of the apparatus of FIG. 5.
Figure 10A:
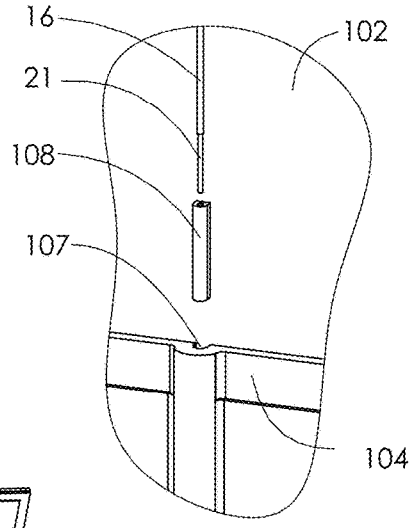
FIG. 10A is an enlarged detailed view taken from FIG. 10, showing a pressure sensor, pressure sensor holder, and communication line operatively associated with each of the first and second inflatable airbags.

With reference to FIG. 10, the various components as described above are shown in an exploded view. With reference, to FIG. 10A, the first pressure sensor 21*a* is shown exposed and removed from a pressure sensor holder 108. The first pressure sensor 21*a* is shown operatively connected to first communication line 16. When assembled, the first pressure sensor 21*a* is held within the pressure sensor holder 108. The first communication line 16 runs along a base sheet 102 of the first inflatable airbag 30*a* and the pressure sensor holder 108 is received within a wire receiving structure 107 formed within a cover sheet 104 of the first inflatable airbag 30*a*. The same configuration applies to the second inflatable airbag 30*b* and any other airbags contemplated herein.

Figure 11:
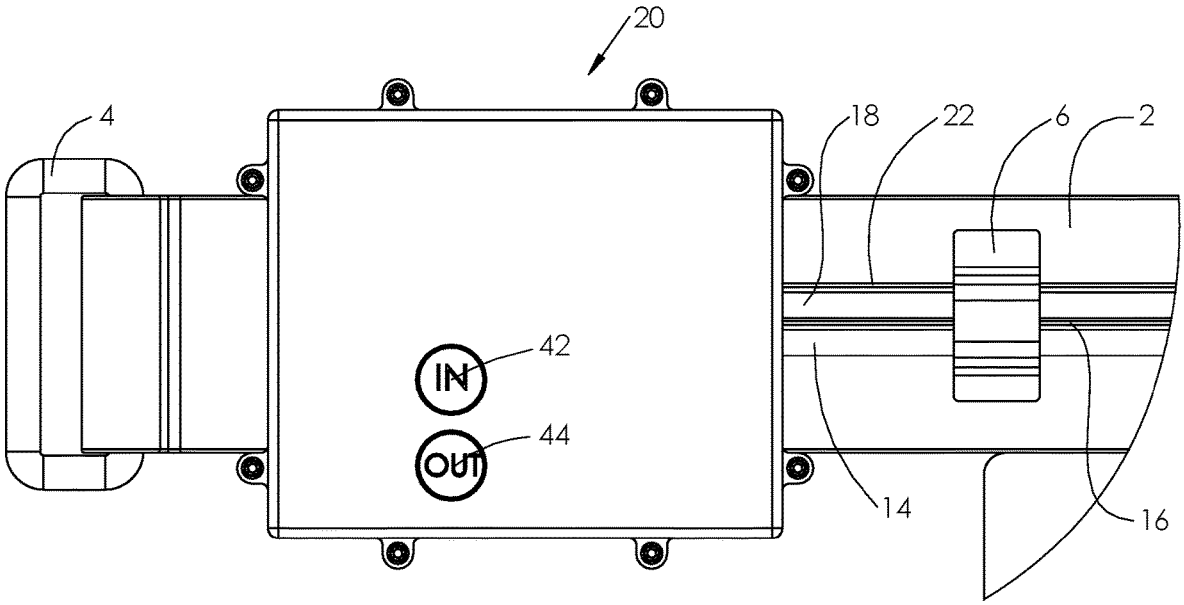
FIG. 11 is a front view of the pump housing unit of FIG. 5, showing means for inflating/deflating each inflatable airbag.

As shown in FIG. 11, the pump housing unit 20 further includes means (e.g., 42, 44) for switching between the first mode of operation (e.g. the airbags 30 are deflated) and the second mode of operation (e.g., the airbags 30 are inflated). The means 42, 44 is operatively associated with the electronic controller 46 (as described in detail below with respect to FIG. 16). In some embodiments, the means 42, 44 can be manually activated. For example, the means 42, 44 can be triggered by a user actively using the means 42, 44 to switch from mode to mode. The means can be in the form of two buttons, one configured to inflate the first inflatable airbag 30*a* and the second inflatable airbag 30*b* and another configured to deflate the first inflatable airbag 30*a* and the second inflatable airbag 30*b*. Any means of switching are contemplated herein (e.g., a switch).

Figure 12:
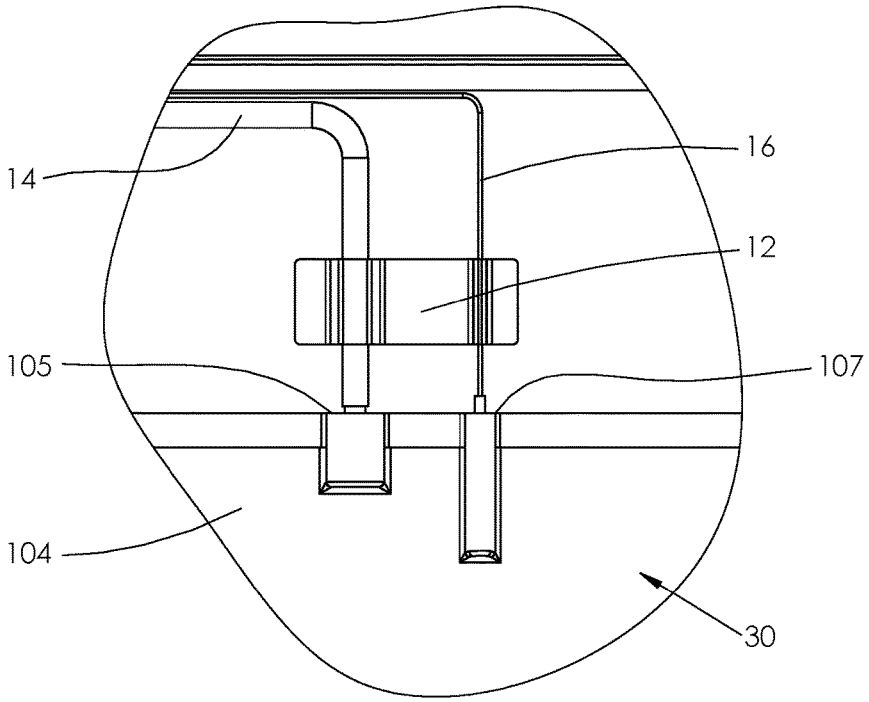
FIG. 12 is an enlarged front view of the inflatable airbag of FIG. 5, showing a tube for supplying air to the inflatable airbag positioned within the inflatable airbag and a communication line to communicate a pressure sensor in the inflatable airbag with an electronic controller.

As shown in FIG. 12, the first communication line 16 is received within the wire receiving structure 107 formed in the cover sheet 104 of the first inflatable airbag 30*a*. The first tube 14 is received within a tube receiving structure 105 formed in the cover sheet 104 of the first inflatable airbag 30*a*. The first communication line 16 and the first tube 14 are shown secured to the base sheet 102 of the first inflatable/deflatable airbag 30*a* via wire/tube holder 12. The same configuration applies to the second inflatable/deflatable airbag 30*b* and any other airbags contemplated herein.

Figure 13:
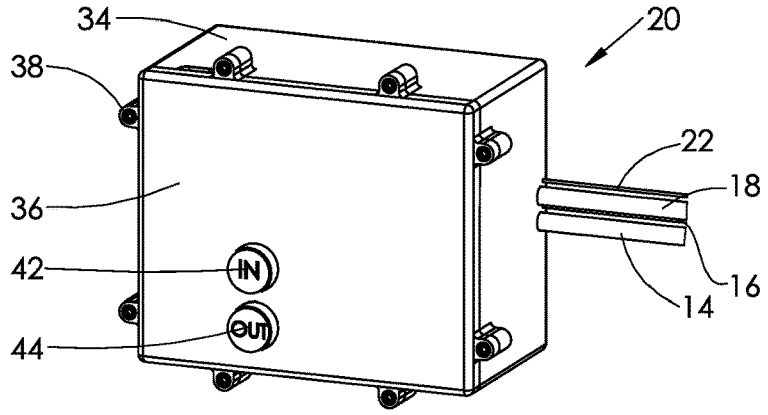
FIG. 13 is a perspective view of the pump control unit of FIG. 11.
Figure 14:
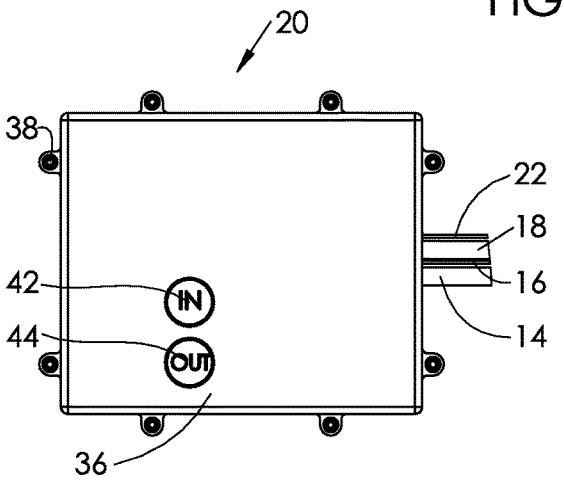
FIG. 14 is a front view of the pump control unit of FIG. 13.
Figure 15:
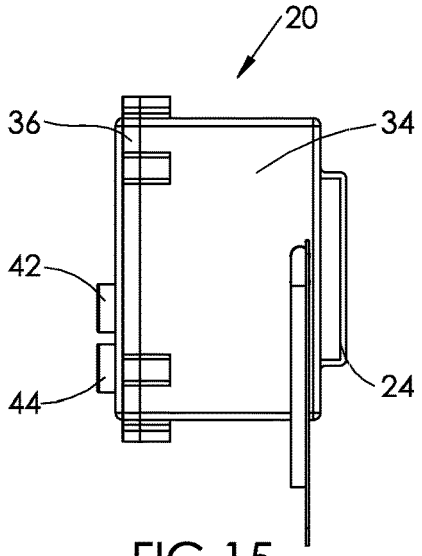
FIG. 15 is a side view of the pump control unit of FIG. 13.

With reference to FIGS. 13-15, the pump housing unit 20 includes a housing base 34 and a housing cover 36 configured to house the inflate/deflate pump 32, and electronic controller 46. The pump housing base 34 and pump housing cover 36 are configured to enclose the inflate/deflate pump, e.g., by means of screws 38 or any other means for attaching parts.

With reference to FIGS. 16 and 17, pump housing unit 20 is shown in exploded view. The pump housing base 34 is shown detached from the pump housing cover 36. Inflate/deflate pump 32, which is housed within the pump housing unit 20, is shown. Electronic controller 46, which is also housed within pump housing unit 20, is shown. The electronic controller 46 is operatively associated with the inflate/deflate pump 32 and is shown connected to the first and second wires 16, 22, which in turn are connected to the first and second pressure sensors 21*a*, 21*b* located in each of the first and second inflatable airbags 30*a*, 30*b*. A rechargeable battery 26 is shown operatively associated with the electronic controller 46. The means 42, 44 are shown operatively associated with the electronic controller 46. A printed circuit board (PCB) 28 is used to connect the rechargeable battery 26 to the electronic controller 46 via a connector 52. Each of the first and second tubes 14, 18 are shown and are configured to be connected to air ports located on the inflate/deflate air pump 32 (described in detail below with respect to FIG. 19).

Figure 18:
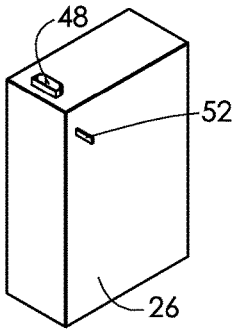
FIG. 18 is a perspective view of a battery which is located within the pump outing unit of FIG. 13.

As shown in FIG. 18, the rechargeable battery 26 includes a charging port 48. The rechargeable battery 26 is operatively associated with a connector 52, which is configured to connect the rechargeable battery 26 with the PCB 28.

Figure 19:
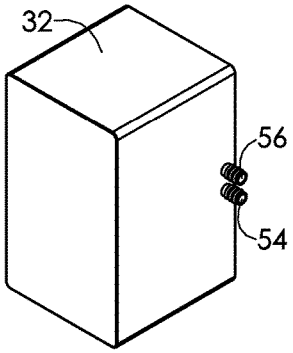
FIG. 19 is a perspective view of the inflate/deflate pump of FIG. 16.
Figure 20:
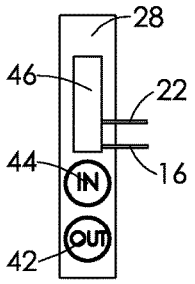
FIG. 20 is a front view of a printed circuit board (PCB) of FIG. 16 showing electronic controller and means to inflate/deflate the inflatable airbags associated therewith.
Figure 21:
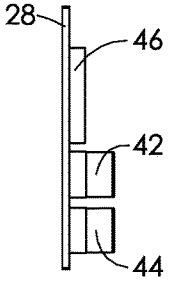
FIG. 21 is a side view of the PCB of FIG. 20.

As shown in FIG. 19, the inflate/deflate air pump 32 includes two air ports 54 and 56. Each air port is configured to inflate and deflate each of the first and second inflatable/deflatable airbags 30*a*, 30*b*. For example, air port 54 is operatively connected to first air tube 14 and airport 56 is operatively connected to second air tube 18. As shown in FIGS. 20-21, the means 42, 44 for controlling the inflation/deflation of the airbags 30 are operatively associated with the PCB 28. The electronic controller 46 is also operatively associated with the PCB 28 allowing the means 42, 44 to communicate with the electronic controller 46 in order to inflate/deflate the inflatable airbags 30.

Figure 22:
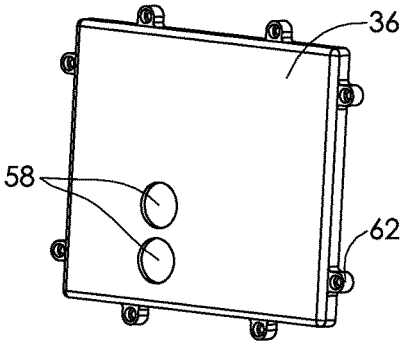
FIG. 22 is a perspective view of the pump housing cover of FIG. 16.

In FIG. 22, the pump housing cover 36 is shown. The pump housing cover 36 is shown with two holes 58 extending therethrough, configured for the means 42, 44 to come through such that a user is able to make contact with the means 42, 44 to manually control when the airbag assembly 10 enters the first mode of operation and the second mode of operation. The pump housing cover 36 is shown with receiving structures 62 configured to receive screws 38 and secure the pump housing cover 36 to the pump housing base 34. The receiving structures 62 can be spaced apart around the outer perimeter of the housing cover 36 and extending outwardly therefrom. Any other arrangement of the receiving structures 62 is contemplated herein. For example, the receiving structured 62 can be formed within the pump housing cover 36.

Figure 23:
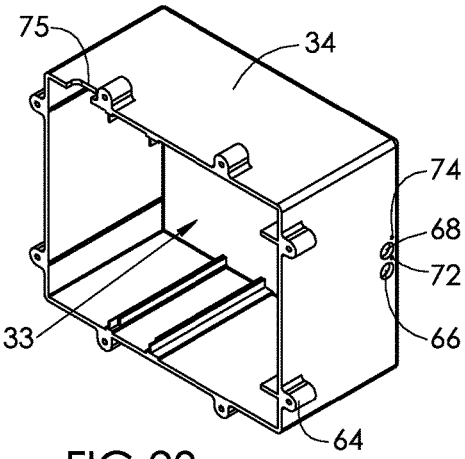
FIG. 23 is perspective view of the pump housing base of FIG. 16.
Figure 24:
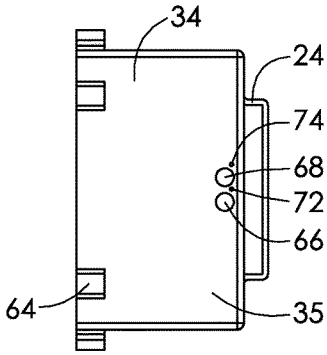
FIG. 24 is a side view of the pump housing base of FIG. 23.

With reference to FIGS. 23 and 24, the pump housing base 34 is shown. The pump housing base 34 is configured to house the inflate/deflate pump 32, and electronic controller 46 within the cavity 33. The pump housing base 34 includes two sets of holes in sidewall 35. The first set of holes 66, 68 are configured to allow the first tube 14 and the second tube 18 to pass through the sidewall 35 of the pump housing unit 20 and connect the inflate/deflate pump 32 to each of the first and second inflatable airbags 30*a*, 30*b*. The second set of holes 72, 74 are configured to allow the first communication line 16 and the second communication line 22 to pass through the sidewall 35 of the pump housing unit 20 to connect the electronic controller 46 to each of the first and second pressure sensors 21*a*, 21*b* within the first and second inflatable airbags 30*a*, 30*b*. Pump housing base 34 further includes receiving structures 64 configured to be aligned with receiving structures 62 of pump housing cover 36 so that screws 38 can go through the receiving structures 62 of the pump housing cover 36 into the receiving structures 64 of the pump housing base, securing them to each other. The receiving structures 64 can be spaced apart around the outer perimeter of the pump housing base 34 and extending outwardly therefrom. Any other arrangement of the receiving structures 64 is contemplated herein. For example, the receiving structured 64 can be formed within the pump housing base 34. In FIG. 24, the pump housing base 34 is shown from the side. Belt holder structure 24 is shown extending from the back of the pump housing base 34.

Figure 25:
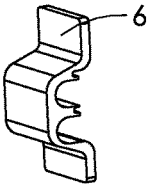
FIG. 25 is a perspective view of a wire/tube holder.
Figure 26:
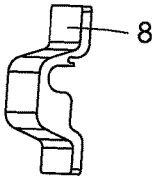
FIG. 26 is a perspective view of another wire/tube holder.
Figure 27:
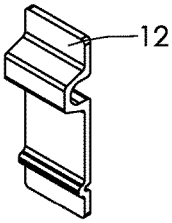
FIG. 27 is a perspective view of another wire/tube holder.

With reference to FIGS. 25-27, each of three various arrangements of the tube/wire holder 6, 8, 12 to be attached to various points on the belt 2 and the airbag 30 are shown. For example, wire/tube holder 6 is configured to be positioned between the pump housing unit 20 and the first inflatable/deflatable airbag 30*a*, wire/tube holder 8 is configured to be placed between the first inflatable/deflatable airbag 30*a* and the second inflatable/deflatable airbag 30*b*, and the wire/tube holder 12 is configured to be placed on each of the first and second inflatable/deflatable airbags 30*a*, 30*b*. Wire/tube holder 6 is configured to secure the first and second communication lines 16, 22 and the first and second tubes 14, 18 to the belt 2. Wire/tube holder 8 is configured to secure the second communication line 22 and the second tube 18 to the belt 2. Wire/tube holder 12 is configured to secure the first communication line 16 and the first tube 14 to the first airbag 30*a*, the second communication line 22 and the second tube 18 to the first airbag 30*b*.

Figure 28:
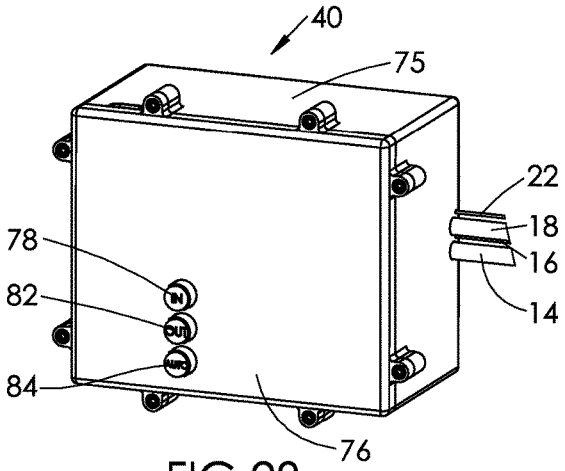
FIG. 28 is a perspective view of a pump housing unit showing a means for activating/deactivating a position sensor.
Figure 29:
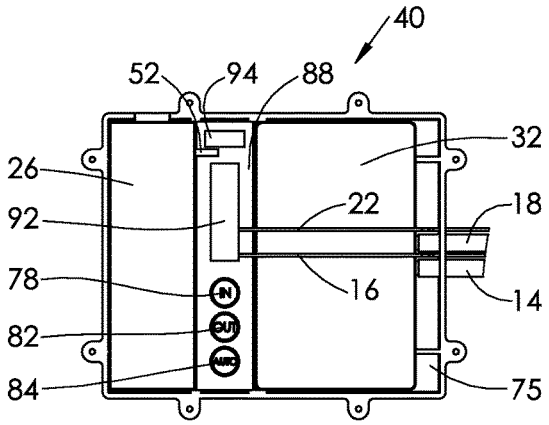
FIG. 29 is a front view of the pump housing unit of FIG. 28, showing a pump housing unit cover removed.
Figure 30:
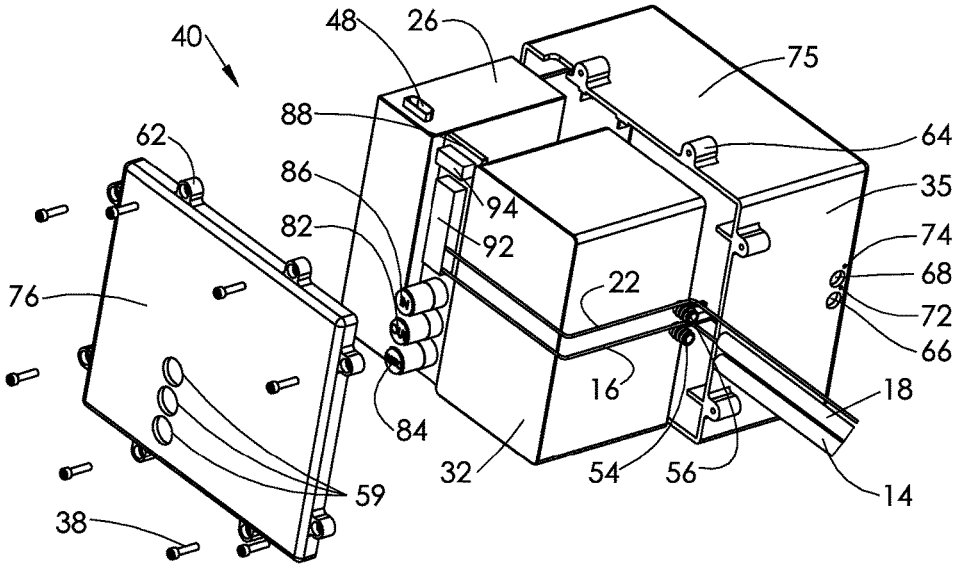
FIG. 30 is an exploded view of the pump housing unit of FIG. 28, showing an inflate/deflate pump and an electronic controller.

With reference to FIGS. 28-30, in another embodiment the pump housing unit 40 includes a position sensor 94 (shown in FIG. 30) operatively associated with the electronic controller 92 (shown in FIG. 30) for sensing a change in a user's position. The pump housing unit 40 further includes means 84 for activating and/or deactivating the position sensor 94. The means for activating and/or deactivating the position sensor 94 is operatively associated with the electronic controller 92. Upon sensing a change in the user's position from a first position (e.g., when the user is sitting, or laying down, not moving) to a second position (e.g., when the user is standing or moving around), the electronic controller 92 commands the inflate/deflate pump 32 (shown in FIG. 30) to inflate the first inflatable airbag 30*a* and the second inflatable airbag 30*b*. Upon sensing a change in the user's position from the second position (e.g., when the user is standing or moving around) to a third position (e.g., the user is sitting, laying down, or not moving), the electronic controller 92 commands the inflate/deflate pump 32 to deflate the first inflatable airbag 30*a* and the second inflatable airbag 30*b*. The pump housing unit 40 further includes means 78, 82 for providing an option to manually inflate/deflate the first and second inflatable airbags 30*a*, 30*b*.

In this embodiment, the activation signal to inflate/deflate the bags can be either manual (e.g., by the user activating the means as described above) or automatic (e.g., by the position sensor 94 sending a signal to the electronic controller to inflate/deflate the airbags 30). If a user wishes to use this embodiment in a manual mode, means 84 can be pressed to deactivate the position sensor 94, and the user can use means 78, 82 to choose when to inflate/deflate the airbags 30. If a user wishes to use this embodiment in an automatic mode, the user can press the means 84 to activate the position sensor 94, so that it will inflate and deflate based on detecting the user's position as described above.

With continued reference to FIGS. 28-30, pump housing unit 40 includes a pump housing base 75 and a pump housing cover 76 configured to house the inflate/deflate pump 32 and electronic controller 92. The pump housing base 75 and pump housing cover 76 are configured to enclose the inflate/deflate pump 32 and electronic controller 92, e.g., by means of screws 38 or any other means for attaching parts.

In FIG. 29, the inflate/deflate pump 32 is shown within the pump housing base 75. Electronic controller 92 is also shown, within pump housing base 75 and operatively associated with the inflate/deflate pump 32. A rechargeable battery 26 is shown operatively associated with the electronic controller 92. The rechargeable battery 26 is connected to a PCB 88 via a connector 52 allowing the rechargeable battery 26 to communicate with the electronic controller 92. First communication line 16 and second communication line 22 are shown operatively connected to the electronic controller 26 to connect the electronic controller 92 to each of the pressure sensors 21*a*, 21*b* within each inflatable airbag 30.

With reference to FIG. 30, the pump housing cover 76 is shown with three holes 59 extending therethrough, configured for the means 78, 82, 84 to come through such that a user is able to make contact with the means 78, 82, 84 to manually or automatically control when the airbag assembly 10 is used in a manual or automatic mode. The pump housing cover 76 is shown with receiving structures 62 configured to receive screws 38 and secure the pump housing cover 76 to the pump housing base 75. The receiving structures can be spaced apart around the outer perimeter of and extending from the pump cover housing 76. Any other arrangement of the receiving structures 62 is contemplated herein. Pump housing base 75 included corresponding receiving structures 64 configured to be aligned with receiving structures 62 to receive screw 38 to attach the pump housing cover 76 and the pump housing base 75.

The pump housing base 75 is shown housing the inflate/deflate pump 32, and electronic controller 92 within the cavity 33 as shown. The pump housing base 75 includes two sets of holes in sidewall 35. The first set of holes 66, 68 are configured to allow the first tube 14 and the second tube 18 to pass through the sidewall 35 of the pump housing unit 40 so as to connect the two-way air pump 32 to each of the first and second inflatable airbags 30*a*, 30*b*. The second set of holes 72, 74 are configured to allow the first communication line 16 and the second communication line 22 to pass through the sidewall 35 of the pump housing unit 40 to connect the electronic controller 92 to each of the first and second inflatable airbags 30*a*, 30*b*. The two-way air pump is shown having air ports 54, 56 as described above.

Figure 31:
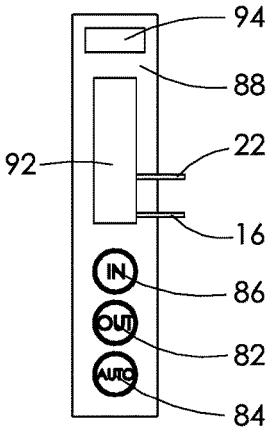
FIG. 31 is a front view of a PCB of the pump housing unit of FIG. 28, showing the electronic controller, a position sensor, and means for inflating/deflating the inflate/deflate pump and the activation of the position sensor associated therewith.
Figure 32:
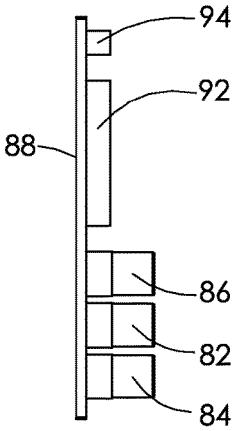
FIG. 32 is a side view of a PCB of FIG. 31.
Figure 33:
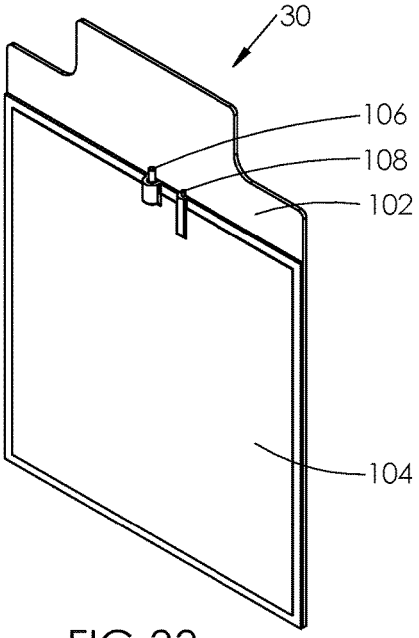
FIG. 33 is a perspective view of an inflatable airbag of the subject disclosure, showing an air inlet and position sensor wire holder connected thereto.
Figure 34:
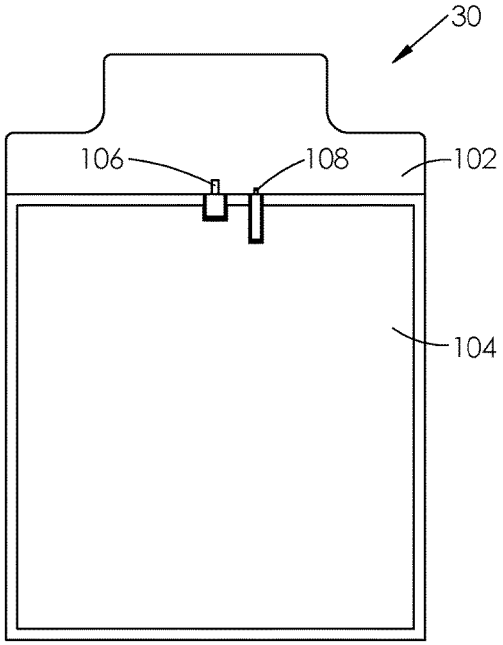
FIG. 34 is a front view of the inflatable airbag of FIG. 33.
Figure 35:
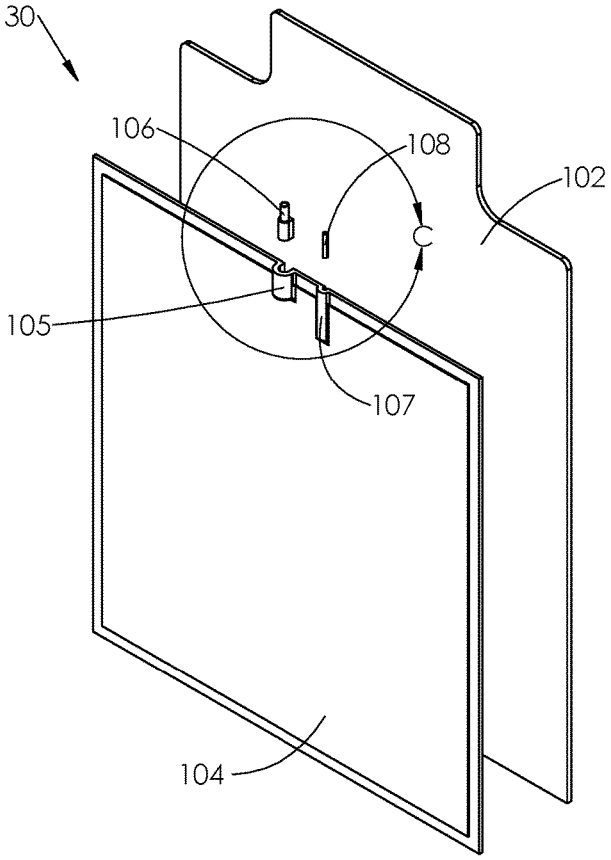
FIG. 35 is an exploded view of the inflatable airbag of FIG. 33, showing an airbag cover sheet removed from an airbag base sheet.
Figure 36:
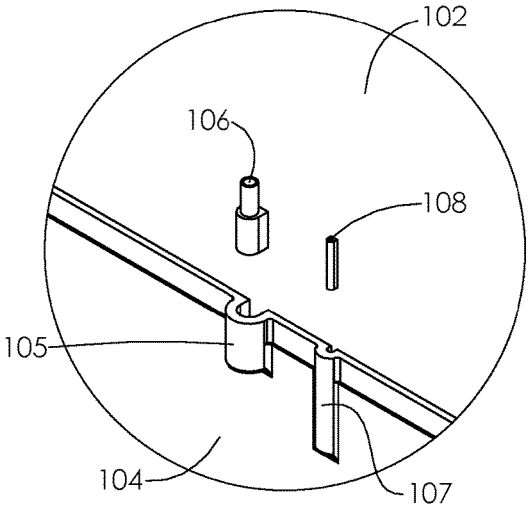
FIG. 36 is a detailed view taken from FIG. 35, showing and an air inlet and position sensor wire holder to be placed within the inflatable airbag.

As shown in FIGS. 31-32, each of the electronic controller 92, the position sensor 94, the means 84 for activating/deactivating the position sensor, and the means 78, 82 for inflating/deflating the airbags 30 are operatively associated with the PCB 88 so that they may communicate with each other.

With reference to FIGS. 33-36, an airbag 30 of the present disclosure is shown. Each airbag includes an airbag base sheet 102 and an airbag coversheet 104 connected thereto. Additionally, the airbag cover sheet includes two receiving structures 105, 107. Receiving structure 105 is configured to receive an air inlet 106 by which the first and second air tubes 14, 18 are connected. Receiving structure 107 is configured to receive airbag pressure sensor wire holder 108 by which the first and second communication 16, 22 lines are configured to be received within. It is contemplated herein that the airbags 30 are light, flexible, plastic inflatable cushions. The airbags 30 can be made from woven fabric, which may be coated or uncoated. The airbags 30 are impermeable to gases and flame-resistant. For example, nylon textiles such as Nylon (polyamide) 6.6 can be used to weave airbag cushions. Any other materials for the airbags 30 are contemplated herein (e.g., inflatable fabrics coated or laminated with synthetic materials to increase their strength and environmental resistance, polyvinyl chloride (PVC) coated vinyl, nylon, oxford woven cloth, etc.).

Figure 37:
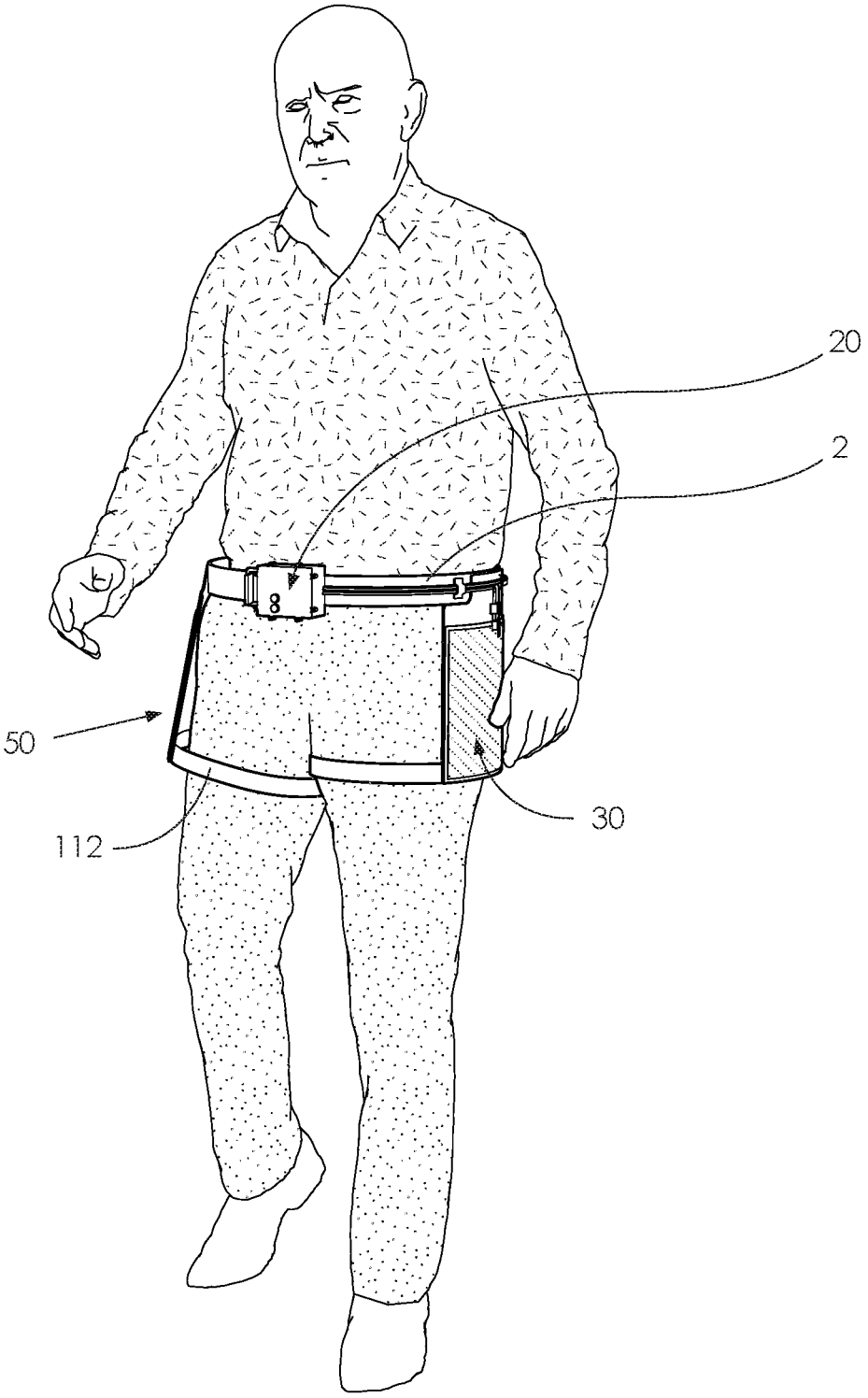
FIG. 37 shows a user wearing an embodiment of an apparatus for protecting a user, which includes leg straps.
Figure 38:
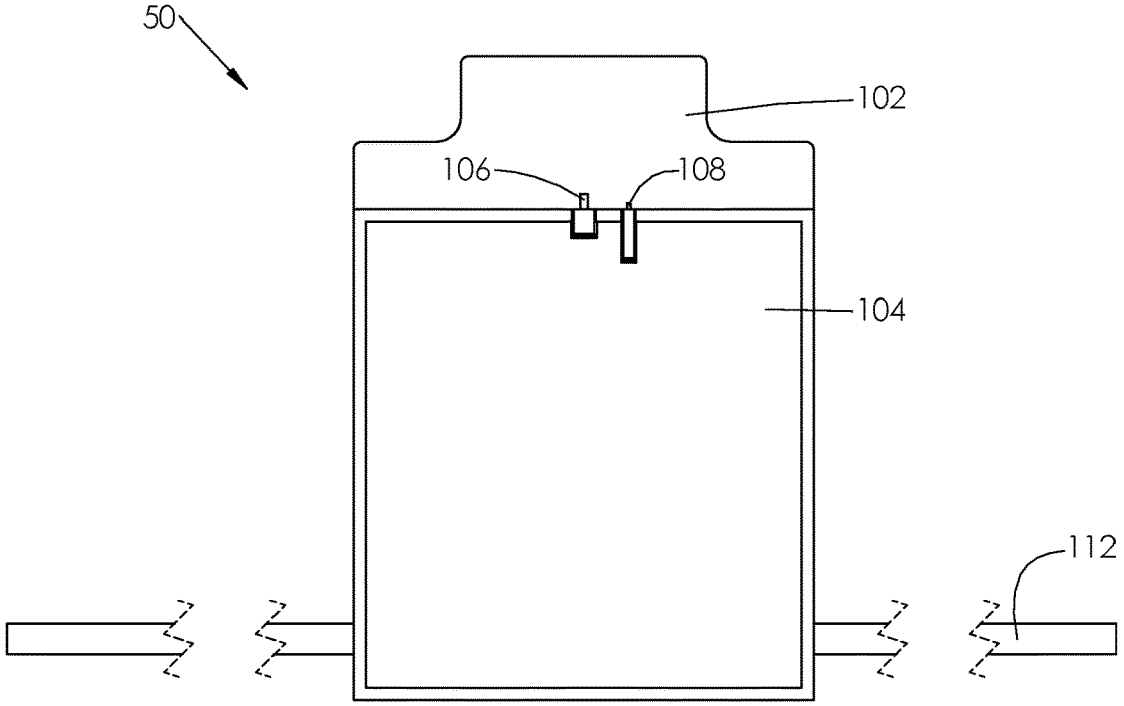
FIG. 38 is a front view of an inflatable airbag of the apparatus of FIG. 37.
Figure 39:
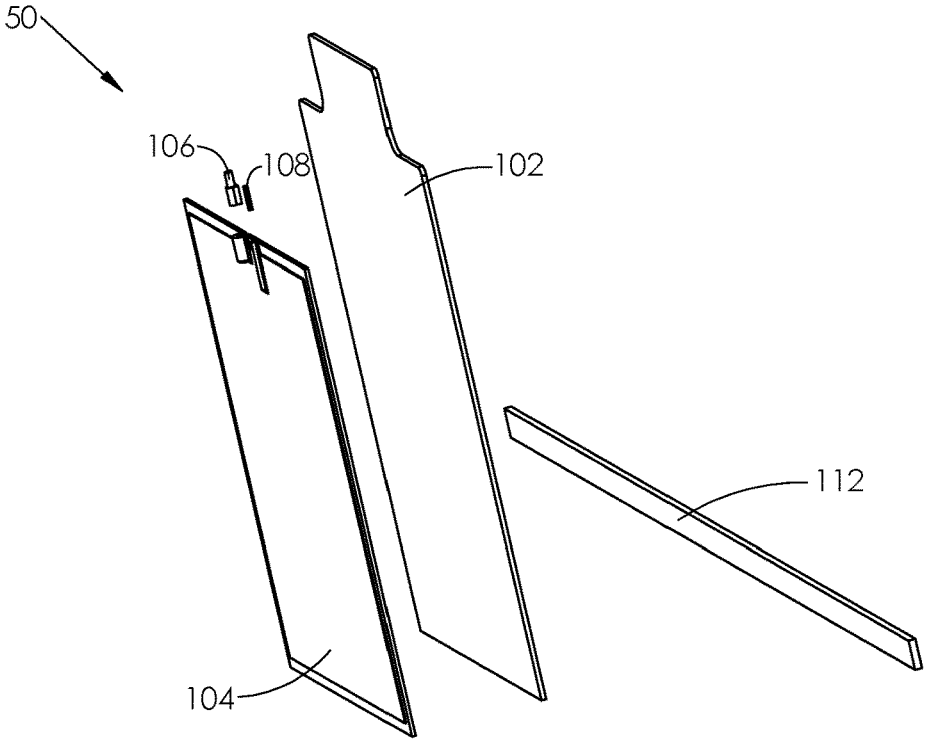
FIG. 39 is an exploded view of the inflatable airbag of FIG. 38.

With reference to FIG. 37, another embodiment of an apparatus for protection of a user 50 is shown. In this embodiment additional leg straps 112 can be included which are configured to wrap around the legs of a user (e.g., Velcro straps or any other suitable strap configured to secure the airbag assembly 50 to the legs of a user). The user is shown wearing the apparatus 50 in a standing position. The apparatus 50 is as described above with respect to apparatus 10 with the addition of straps 112. As shown in FIGS. 38-39, an airbag 30 in accordance with apparatus 50 is shown. The airbag 30 is as described above with the addition of strap 112 which is operatively associated with the base sheet 104 of the airbag 30 at an end opposite of the air inlet 106 and the pressure sensor wire holder 108. Pump housing unit 20 is as described in detail above. Additionally, pump housing unit 40 as described above, can be included in this embodiment.

Figure 40:
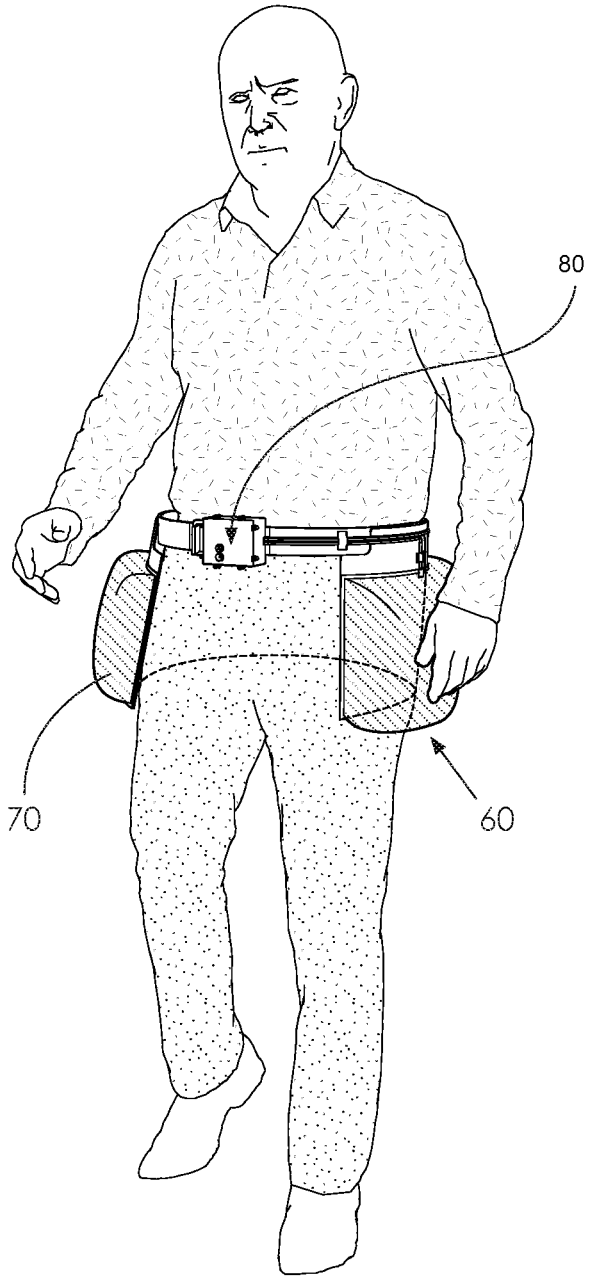
FIG. 40 shows a user wearing an embodiment of an apparatus for protecting a user having one inflatable airbag.
Figure 41:
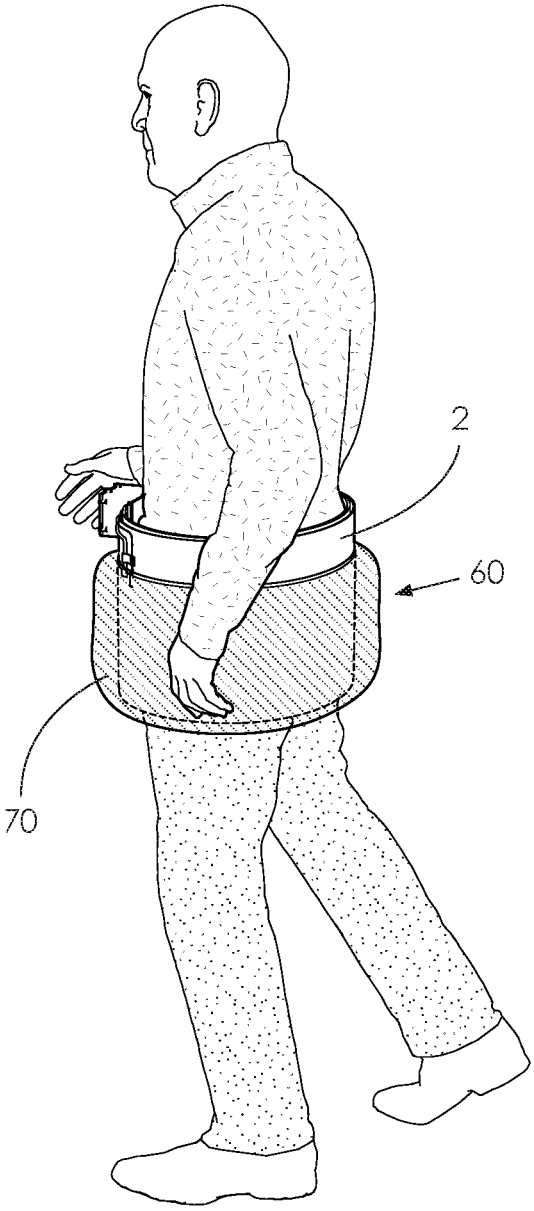
FIG. 41 shows a user wearing the apparatus of FIG. 40, shown from the rear side of the user.

As shown in FIGS. 40-41, another embodiment of the airbag assembly 60 is shown. In this embodiment, the at least one inflatable/deflatable airbag 70 extends substantially around the user's waist. The inflatable/deflatable airbag 70 is shown being worn by a user and is in an inflated position. The airbag assembly 60 is as described above with respect to airbag assembly 10 and airbag 70 is as described above with respect to airbag 30.

Figure 42:
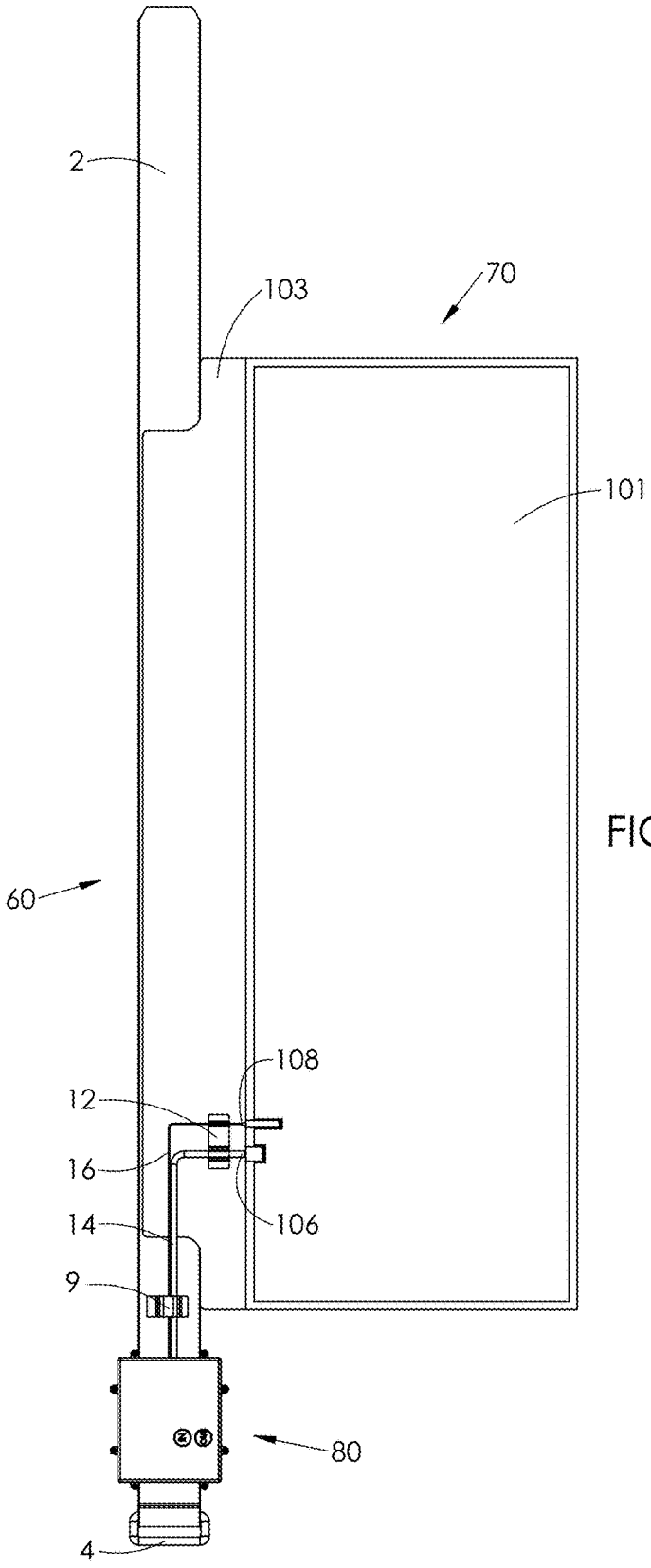
FIG. 42 is a front view of the apparatus of FIG. 40, showing the inflatable airbag and a pump housing unit supported on a belt.

With reference to FIG. 42, another embodiment of an apparatus for protecting a user 60 is shown. The belt 2 is shown with a buckle 4 to secure the belt 2 around the waist of a user. It is contemplated that in addition to a buckle, any means of securing the belt to the waist of a user can be used, e.g., (Velcro strap, tying a knot, etc). The belt is configured to be adjustable so as to accommodate the varying waist sizes of multiple users and can vary in length. The pump unit 80 is shown supported by the belt 2. The inflatable/deflatable airbag 70 is shown supported by belt 2.

A pressure sensor 21 is operatively associated with the inflatable airbag 70 for sensing pressure therein, so as to detect a target pressure therein. The pressure sensor 21 is operatively connected to an electronic controller 46 (e.g., as shown in FIGS. 16 and 17 within the pump housing unit 20) associated with the inflate/deflate pump 32 (e.g., as shown in FIGS. 16 and 17 within the pump housing unit 20) by way of a communication line 16. The communication line 16 is secured to the belt via a wire/tube holder 6 and is secured to the inflatable airbag 30 via wire/tube holder 12.

Figure 43:
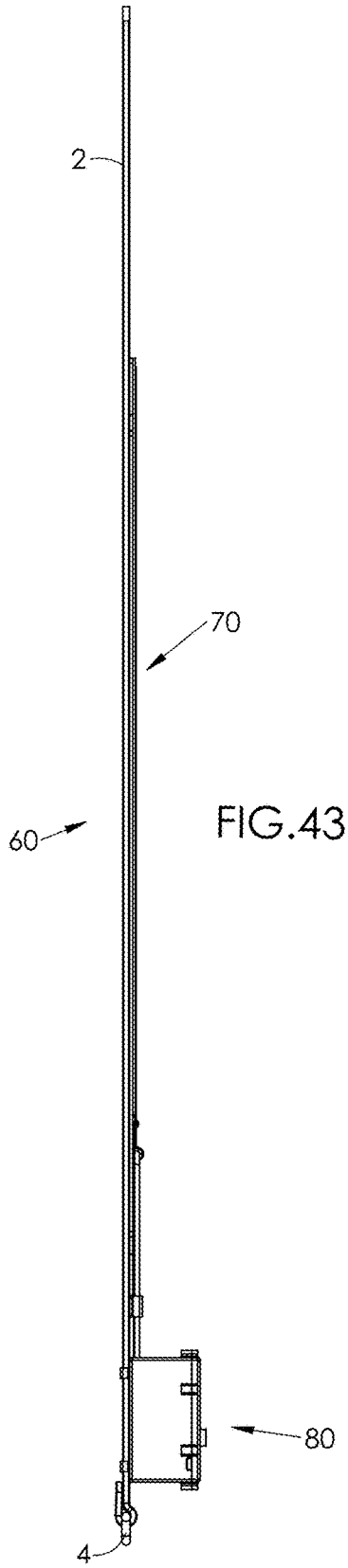
FIG. 43 is a top view of the apparatus of FIG. 42.
Figure 44:
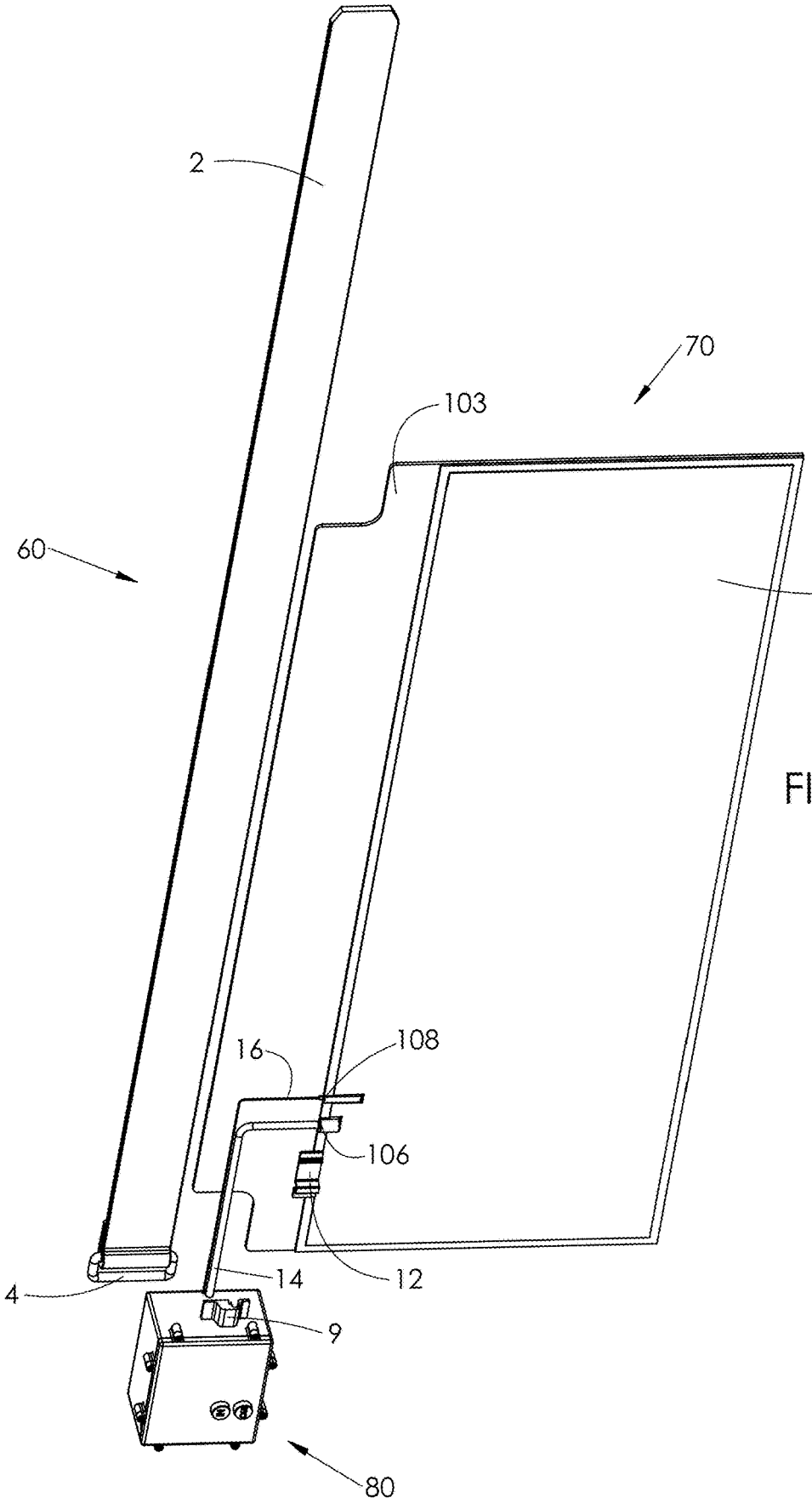
FIG. 44 is an exploded view of the apparatus of FIG. 42.

The pressure sensor 21 is configured and adapted to detect a target pressure. The target pressure is the pressure within the inflatable airbag 30 needed to effectively protect a user upon falling or impact. An impact can include, but is not limited to, an impact of the inflatable airbags coming into contact with the ground after a user falls or the impact of a user bumping into any structure while walking and wearing. The pressure needed can vary based upon the individual user wearing the airbag assembly 60. Upon detecting the target pressure, the inflatable/deflatble airbag 30 is configured to stop inflating. A tube 14 extends from the inflate/deflate pump 32 to the inflatable/deflatable airbag 70 for supplying pressurized air from the inflate/deflate pump 32. The tube 14 is secured to the belt 2 via a wire/tube holder 6 and secured to the inflatable/deflatable airbag 70 via wire/tube holder 12. The airbag 70 has a base sheet 103 which the belt 2 is operatively associated with, and a cover sheet 105 secured thereto. The base sheet 103 and the cover sheet 101 are as described above with respect to base sheet 102 and cover sheet 104. FIG. 43 shows the apparatus 60 from a top view. FIG. 44 shows an exploded view of the airbag assembly 60. The control unit 20 is as described in detail above. Additionally, pump housing unit 40 as described above, can be included in this embodiment.

Figure 45:
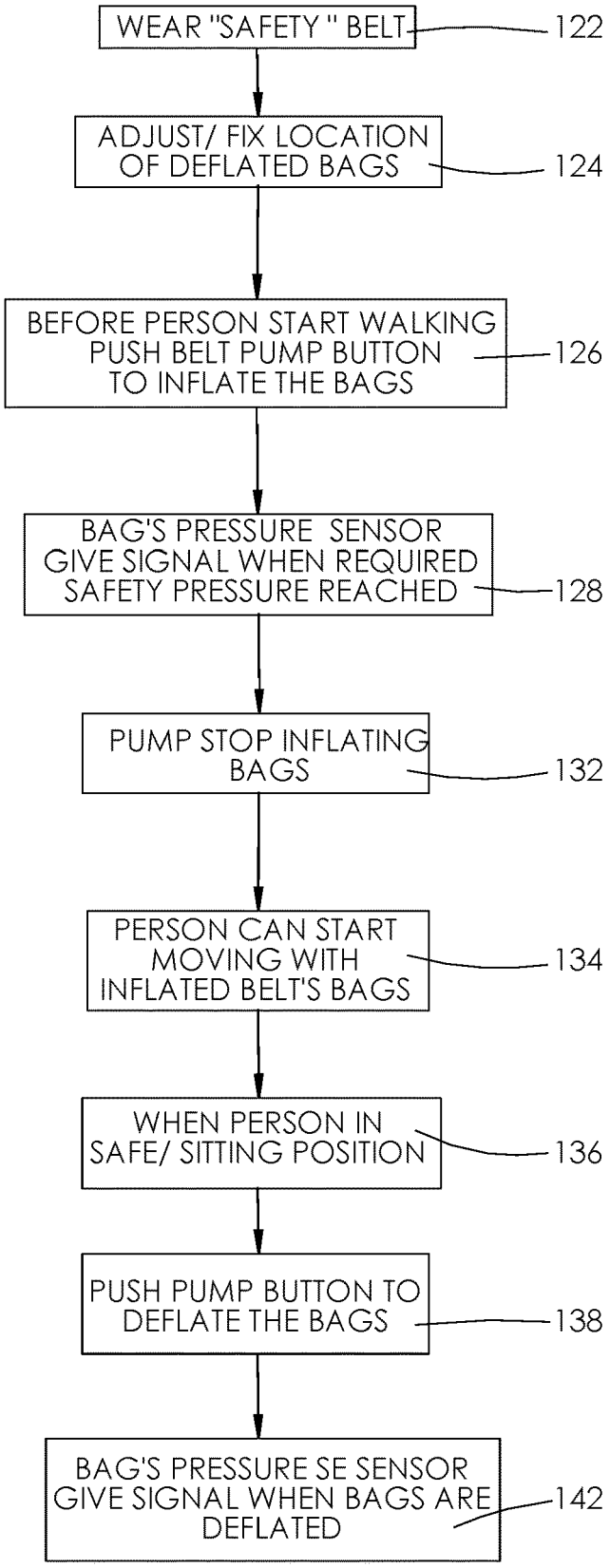
FIG. 45 is a schematic showing a method for manually operating an apparatus for protecting a user of the subject disclosure.

As shown in FIG. 45 and as described above, the apparatus for protecting a user can be operated manually. A method of operating the apparatus manually includes a user sending an activation signal to inflate/deflate the airbags by way of means (e.g., inflate/deflate on/off buttons) associated with the electronic controller. For example, a user wearing the airbag can press a button to inflate the bags before walking (e.g., step 126). The bags will stop inflating upon reaching a target pressure detected by internal pressure sensors (e.g., step 132). When the user is ready to sit and no longer wants the airbags to be inflated, they can press a button to deflate the airbags (e.g., step 138). The airbags will stop deflating upon the pressure sensors giving a signal that they have completed deflation (e.g., the airbags being empty, as shown by step 142).

Figure 46:
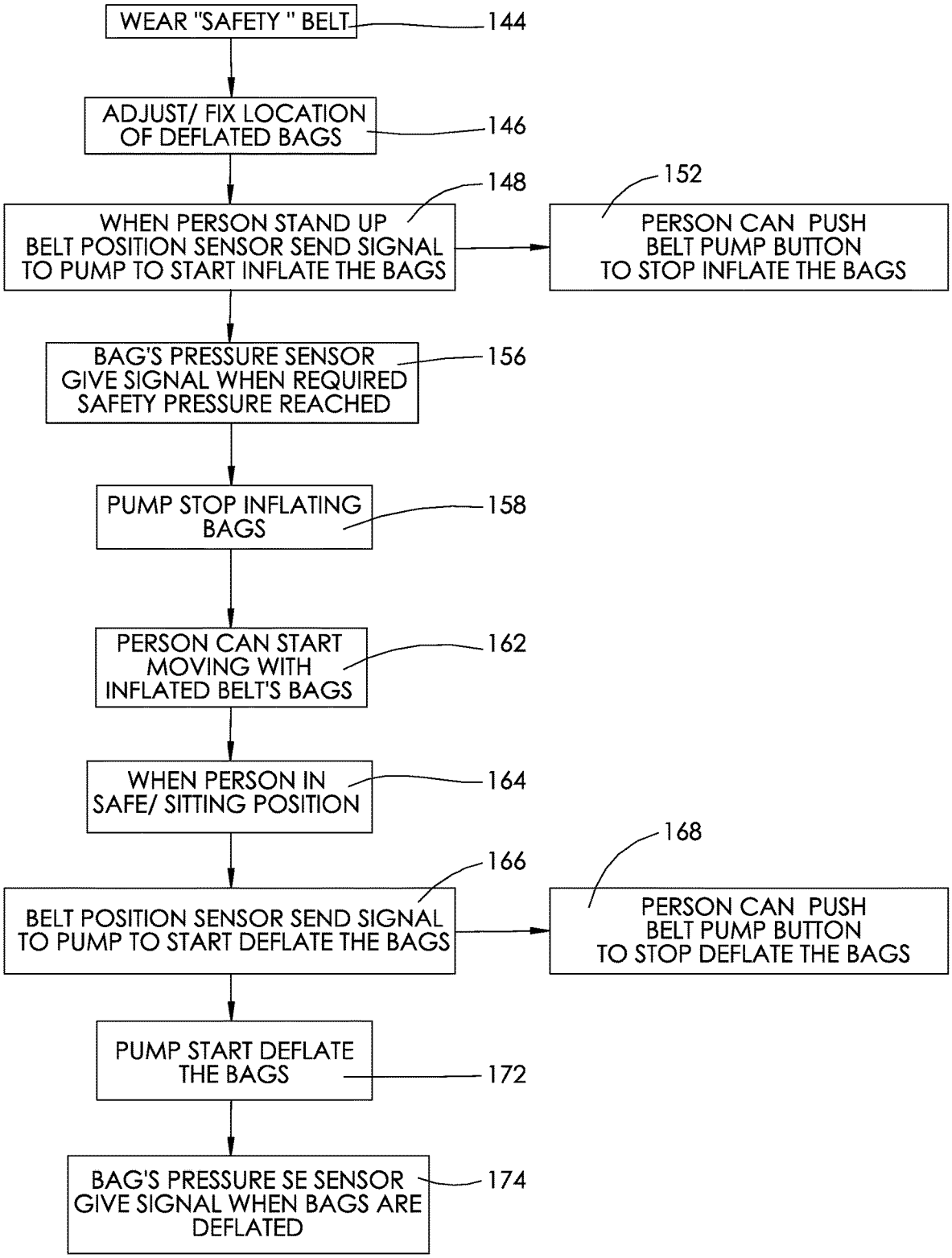
FIG. 46 is a schematic showing a method for automatically operating an apparatus for protecting a user of the present disclosure.

With reference to FIG. 46 and as described above, a method for deploying an apparatus for protecting a user can be manual or automatic. In certain embodiments, the pump housing unit can include both means for inflating/deflating airbags (which can be initiated by a user) and means for activating and deactivating a position sensor. A user can choose to deactivate the position sensor so that the airbag assembly can be operated manually (as shown by the method in FIG. 45), or the user can activate the position sensor to allow the airbag assembly to operated automatically (as shown by the method of FIG. 46). The method to operate the airbag assembly automatically includes providing a user with an airbag assembly configured to be worn around the user's waist, detecting a first change in position of the user wearing the apparatus, inflating the apparatus upon the first change in position of the user, detecting a second change in position of the user wearing the apparatus, and deflating the apparatus upon the second change in position of the user. It is contemplated that an apparatus for protecting a user can include solely manual means of operation, solely automatic means of operation, or can include both and be configured to be operated manually or automatically as desired by the user.

Figure 47:
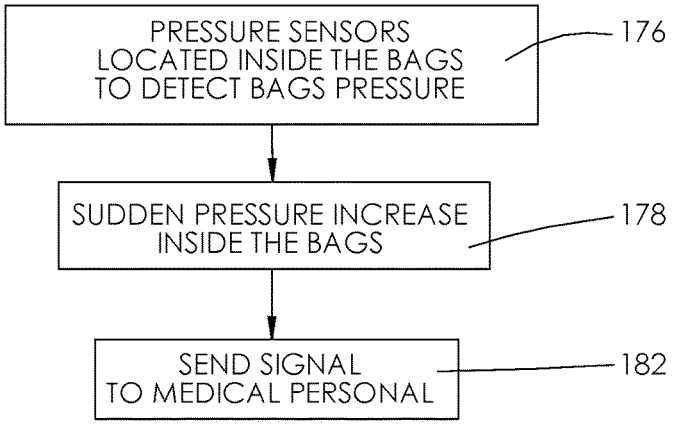
FIG. 47 is a schematic showing a method for monitoring an apparatus for protecting a user of the present disclosure based on a pressure sensor within an inflatable airbag.

With reference to FIG. 47, a method for monitoring an apparatus for protecting a user is shown. The method includes providing a user with an apparatus configured to be worn around the user's waist, detecting a pressure increase in one or more airbags of the apparatus (e.g., internal pressure sensor within the bag detects a change in pressure), and sending an emergency alert signal in response to detecting the pressure increase. Pressure in an airbag is determined by individual pressure sensors within the airbag and operatively connected to an electronic controller as described in detail above.

Figure 48:
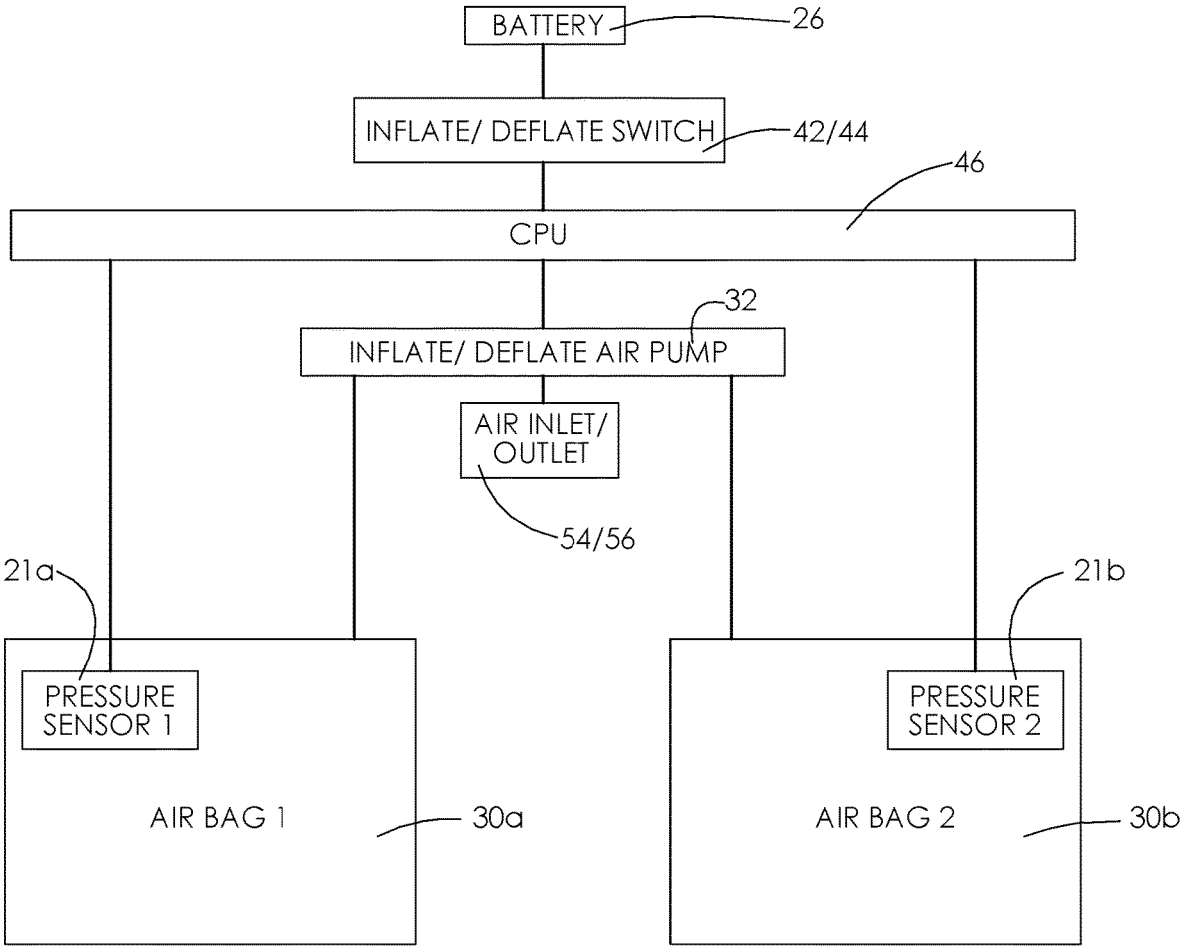
FIG. 48 is a schematic of an apparatus for protecting a user of the present disclosure showing a means for inflating/deflating the apparatus manually.

With reference to FIG. 48, a schematic of the apparatus 10 is shown. As described in detail above, the control unit 20 includes a two-way air pump 32 operatively associated with an electronic controller 46. The two-way air pump 32 is operatively associated with the first and second airbags 30*a*, 30*b* via first and second tubes 14, 18. The electronic controller 46 is operatively associated with a first and second pressure sensor 21*a*, 21*b* via first and second communication lines 16, 22. The two-way air pump 32 further includes an air inlet/outlet 54,56 by which the first and second tubes 14, 18 are connected. A first control valve 194 is operatively associated with the electronic controller 46 for controlling a flow of air between the first inflatable airbag 30*a* and the two-way pump 32. A second control valve 198 is operatively associated with the electronic controller 46 for controlling a flow of air between the second inflatable airbag 30*b* and the two-way pump 32. The first and second control valves 194, 198 can be any type of valve (e.g., solenoids).

Figure 49:
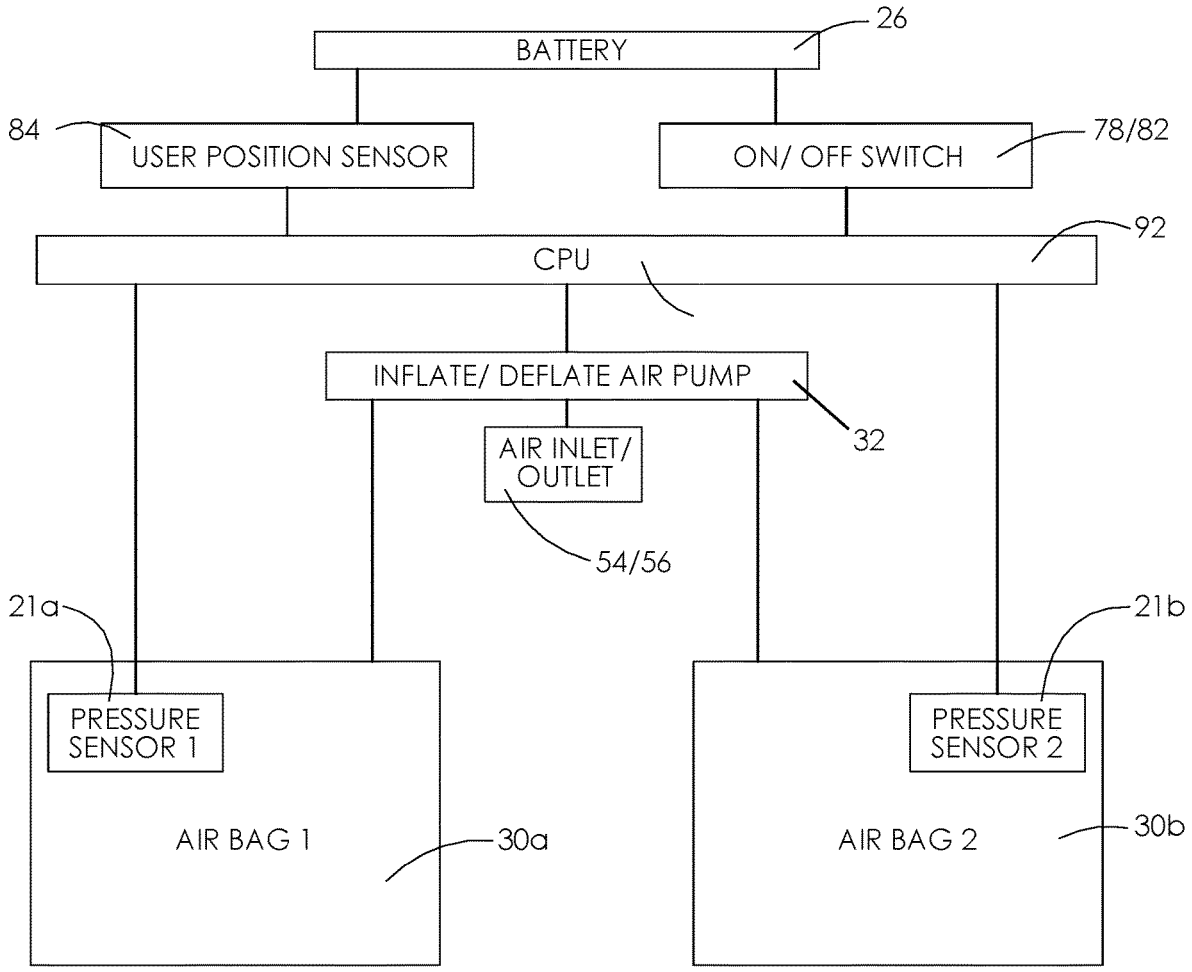
FIG. 49 is a schematic of an apparatus for protecting a user of the present disclosure showing a means for inflating/deflating the apparatus automatically using a position sensor.

FIG. 49 shows an embodiment of the airbag assembly controlled solely by position sensor 94 and no manual means of operation. In this embodiment, the control unit includes a two-way air pump 32 operatively associated with an electronic controller 92. The two-way air pump 32 is operatively associated with the first and second airbags 30*a*, 30*b* via first and second tubes 14, 18. The electronic controller 92 is operatively associated with a first and second pressure sensor 21*a*, 21*b* via first and second communication lines 16, 22. The two-way air pump 32 further includes an air inlet/outlet 54,56 by which the first and second tubes 14, 18 are connected. A position sensor 94 is operatively associated with the electronic controller 92 to detect a change in the user's position and inflate/deflate the airbags accordingly as described in detail above.

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. An apparatus for protecting a user, comprising:

a) an elongated belt dimensioned and configured to be worn about a waist of a user;

b) at least one inflatable/deflatable airbag supported on the belt including a first inflatable/deflatable airbag and a second inflatable/deflatable airbag;

c) an inflate/deflate pump supported on the belt and communicating with the at least one inflatable/deflatable airbag for inflating and/or deflating the at least one inflatable/deflatable airbag upon receiving an activation signal;

d) at least one pressure sensor configured to detect a pressure within the at least one inflatable/deflatable airbag, wherein the at least one pressure sensor includes:

a first pressure sensor operatively associated with the first inflatable/deflatable airbag for sensing pressure therein, so as to detect a first target pressure inside the first inflatable/deflatable airbag, wherein upon detecting the first target pressure, the first pressure sensor sends a signal to the inflate/deflate pump to stop inflating the first inflatable/deflatable airbag, and wherein the first pressure sensor is operatively connected to an electronic controller by way of a first communication line; and a second pressure sensor operatively associated with the second inflatable/deflatable airbag for sensing pressure therein, so as to detect a second target pressure inside the second inflatable/deflatable airbag, wherein upon detecting the second target pressure, the second pressure sensor a sends signal to the inflate/deflate pump to stop inflating the second inflatable/deflatable airbag, and wherein the second pressure sensor is operatively connected to the electronic controller by way of a second communication line;

e) a position sensor operatively associated with the electronic controller for sensing a change in a user's position, wherein the activation signal is initiated by detection of a change in the user's position;

f) a means for activating and/or deactivating the position sensor operatively associated with the electronic controller, wherein upon sensing a change in the user's position from a first position to a second position, the electronic controller commands the inflate/deflate pump to inflate the first inflatable/deflatable airbag and the second inflatable/deflatable airbag, wherein upon sensing a change in the user's position from the second position to a third position, the electronic controller commands the inflate/deflate pump to deflate the first inflatable/deflatable airbag and the second inflatable/deflatable airbag.

2. The apparatus of claim 1, wherein upon detecting the first and second target pressures, the first inflatable/deflatable airbag and the second inflatable/deflatable airbag are configured to stop inflating or to stop deflating.

3. The apparatus of claim 2, wherein a first control valve is operatively associated with the electronic controller for controlling a flow of air between the first inflatable/deflatable airbag and the inflate/deflate pump.

4. The apparatus of claim 3, wherein a second control valve is operatively associated with the electronic controller for controlling a flow of air between the second inflatable/deflatable airbag and the inflate/deflate pump.

5. The apparatus of claim 1, wherein the first inflatable/deflatable airbag and the second inflatable/deflatable airbag are supported on the belt in a spaced apart relationship.

6. The apparatus of claim 5, wherein a first tube extends from the inflate/deflate pump to the first inflatable/deflatable airbag for supplying pressurized air from the inflate/deflate pump.

7. The apparatus of claim 6, wherein a second tube extends from the inflate/deflate pump to the second inflatable/deflatable airbag for supplying pressurized air from the inflate/deflate pump.

8. The apparatus of claim 1, wherein the electronic controller is operatively associated with the inflate/deflate pump for activating the inflate/deflate pump upon receiving the activation signal, wherein the activation signal is initiated by a user.

9. The apparatus of claim 8, wherein the inflate/deflate pump is configured and adapted to inflate the first inflatable/deflatable airbag and the second inflatable/deflatable airbag in a first mode of operation after receiving the activation signal and configured and adapted to deflate the first inflatable/deflatable airbag and the second inflatable/deflatable airbag in a second mode of operation after receiving the activation signal.

10. The apparatus of claim 9, further including means for switching between the first mode of operation and the second mode of operation, and wherein the means is operatively associated with the electronic controller.

11. An apparatus for protecting a user, comprising:

a) an elongated belt dimensioned and configured to be worn about a waist of a user;

b) at least one inflatable/deflatable airbag supported on the belt, wherein the at least one inflatable/deflatable airbag includes a first inflatable/deflatable airbag and a second inflatable/deflatable airbag;

c) an inflate/deflate pump supported on the belt and communicating with the at least one inflatable/deflatable airbag for inflating the at least one inflatable/deflatable airbag upon receiving an activation signal indicative of a change in the user's position, d) a first pressure sensor operatively associated with the first inflatable/deflatable airbag for sensing pressure therein, and wherein the first pressure sensor is operatively connected to an electronic controller by way of a first communication line;

e) a second pressure sensor is operatively associated with the second inflatable/deflatable airbag for sensing pressure therein, and wherein the second pressure sensor is operatively connected to the electronic controller by way of a second communication line; and f) a position sensor is operatively associated with the electronic controller for sensing a change in a user's position, wherein upon sensing a change in the user's position from a first position to a second position, the electronic controller commands the inflate/deflate pump to inflate the first inflatable/deflatable airbag and the second inflatable/deflatable airbag, wherein upon sensing a change in the user's position from the second position to a third position, the electronic controller commands the inflate/deflate pump to deflate the first inflatable/deflatable airbag and the second inflatable/deflatable airbag.

12. The apparatus of claim 11, wherein the first pressure sensor and the second pressure sensor are configured and adapted to detect a target pressure, wherein upon detecting the target pressure, the first inflatable/deflatable airbag and the second inflatable/deflatable airbag are configured to stop inflating or to stop deflating, wherein the first pressure sensor and the second pressure sensor are operatively connected to an electronic controller associated with the inflate/deflate pump by way of the first communication line and the second communication line.

13. The apparatus of claim 12, wherein a first control valve is operatively associated with the electronic controller for controlling a flow of air between the first inflatable/deflatable airbag and the inflate/deflate pump.

14. The apparatus of claim 13, wherein a second control valve is operatively associated with the electronic controller for controlling a flow of air between the second inflatable/deflatable airbag and the inflate/deflate pump.

15. The apparatus of claim 14, wherein the first inflatable/deflatable airbag and the second inflatable/deflatable airbag are supported on the belt in a spaced apart relationship.

16. The apparatus of claim 15, wherein a first tube extends from the inflate/deflate pump to the first inflatable/deflatable airbag for supplying pressurized air from the inflate/deflate pump.

17. The apparatus of claim 16, wherein a second tube extends from the inflate/deflate pump to the second inflatable/deflatable airbag for supplying pressurized air from the inflate/deflate pump.

18. The apparatus of claim 11, wherein the electronic controller is operatively associated with the inflate/deflate pump for activating the inflate/deflate pump upon receiving the activation signal indicative of a change in the user's position.

19. A method for deploying the apparatus of claim 11, the method comprising:

a) providing a user with the apparatus, wherein the apparatus is worn around the user's waist;

b) sending a first activation signal to inflate the at least one inflatable/deflatable airbag by way of the means associated with the electronic controller; and c) sending a second activation signal to deflate the at least one inflatable/deflatable airbag by way of the means.

20. A method for monitoring an apparatus for protecting a user, the method comprising:

a) providing a user with the apparatus of claim 11 wherein the apparatus is worn around the user's waist;

b) detecting a pressure increase in the at least one inflatable/deflatable airbag of the apparatus; and c) sending an emergency alert signal in response to detecting the pressure increase inside the at least one inflatable/deflatable airbag.

* * * * *